US010597765B2

(12) United States Patent
Shiga et al.

(10) Patent No.: US 10,597,765 B2
(45) Date of Patent: Mar. 24, 2020

(54) STEEL, CARBURIZED STEEL COMPONENT, AND METHOD FOR MANUFACTURING CARBURIZED STEEL COMPONENT

(71) Applicant: NIPPON STEEL & SUMITOMO METAL CORPORATION, Tokyo (JP)

(72) Inventors: Akira Shiga, Hokkaido (JP); Manabu Kubota, Nishinomiya (JP); Hajime Hasegawa, Hokkaido (JP); Hideo Mizukami, Kashima (JP)

(73) Assignee: NIPPON STEEL CORPORATION, Tokyo (JP)

( * ) Notice: Subject to any disclaimer, the term of this patent is extended or adjusted under 35 U.S.C. 154(b) by 159 days.

(21) Appl. No.: 15/777,746

(22) PCT Filed: Nov. 25, 2016

(86) PCT No.: PCT/JP2016/084977
§ 371 (c)(1),
(2) Date: May 21, 2018

(87) PCT Pub. No.: WO2017/090731
PCT Pub. Date: Jun. 1, 2017

(65) Prior Publication Data

US 2018/0371603 A1 Dec. 27, 2018

(30) Foreign Application Priority Data

Nov. 27, 2015 (JP) ..... 2015-232117

(51) Int. Cl.

| | |
|---|---|
| ***C23C 8/32*** | (2006.01) |
| ***C21D 8/06*** | (2006.01) |
| ***C21D 9/28*** | (2006.01) |
| ***C21D 9/32*** | (2006.01) |
| ***C21D 1/06*** | (2006.01) |
| ***C22C 38/60*** | (2006.01) |
| ***C23C 8/02*** | (2006.01) |
| ***C23C 8/80*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C22C 38/44*** | (2006.01) |

(Continued)

(52) U.S. Cl.
CPC ..... *C23C 8/32* (2013.01); *C21D 1/06* (2013.01); *C21D 8/06* (2013.01); *C21D 9/28* (2013.01); *C21D 9/32* (2013.01); *C22C 38/002* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/28* (2013.01); *C22C 38/32* (2013.01); *C22C 38/44* (2013.01); *C22C 38/50* (2013.01); *C22C 38/54* (2013.01); *C22C 38/60* (2013.01); *C23C 8/02* (2013.01); *C23C 8/22* (2013.01); *C23C 8/80* (2013.01); *C21D 2211/005* (2013.01)

(58) Field of Classification Search
CPC ..... C23C 8/32; C22C 38/002; C22C 38/54; C22C 38/50; C22C 38/44; C22C 38/32; C21D 1/06; C21D 9/28; C21D 8/06; C21D 9/32
See application file for complete search history.

(56) References Cited

U.S. PATENT DOCUMENTS

2002/0044878 A1 4/2002 Yaguchi et al.
2004/0048217 A1* 3/2004 Hayashi ..... C21D 1/78 432/1

(Continued)

FOREIGN PATENT DOCUMENTS

CN 101184859 A 5/2008
EP 1507016 A1 2/2005

(Continued)

OTHER PUBLICATIONS

International Search Report for PCT/JP2016/084977 dated Feb. 14, 2017.

(Continued)

*Primary Examiner* — Jessee R Roe

(74) *Attorney, Agent, or Firm* — Birch, Stewart, Kolasch & Birch, LLP

(57) ABSTRACT

A steel according to an aspect of the present invention has a chemical composition within a predetermined range, in which a hardenability index Ceq ranges from greater than 7.5 to smaller than 44.0, a metallographic structure includes ferrite ranging from 85 to 100 area %, an average distance between sulfides, which are observed in a cross section parallel to a rolling direction of the steel and have an equivalent circle diameter ranging from 1 μm or greater to smaller than 2 μm, is shorter than 30.0 μm, and a presence density of the sulfides, which are observed in the cross section parallel to the rolling direction of the steel and have an equivalent circle diameter ranging from 1 μm or greater to smaller than 2 μm, is 300 pieces/mm$^2$ or more.

7 Claims, 1 Drawing Sheet

(51) Int. Cl.

| | |
|---|---|
| ***C22C 38/50*** | (2006.01) |
| ***C22C 38/54*** | (2006.01) |
| ***C23C 8/22*** | (2006.01) |

(56) References Cited

U.S. PATENT DOCUMENTS

| | | | |
|---|---|---|---|
| 2009/0050241 | A1 | 2/2009 | Hashimura et al. |
| 2013/0146180 | A1 | 6/2013 | Kubota |
| 2013/0146181 | A1 | 6/2013 | Kubota |
| 2016/0237515 | A1 | 8/2016 | Kajihara et al. |

FOREIGN PATENT DOCUMENTS

| | | | |
|---|---|---|---|
| JP | 2001-234279 | A | 8/2001 |
| JP | 2002-69569 | A | 3/2002 |
| JP | 2005-232508 | A | 9/2005 |
| JP | 2011-184768 | A | 9/2011 |
| JP | 2013-18999 | A | 1/2013 |
| JP | 5135562 | B2 | 2/2013 |
| JP | 5135563 | B2 | 2/2013 |
| JP | 5458048 | B2 | 4/2014 |
| KR | 10-2005-0075019 | A | 7/2005 |
| WO | WO 02/44436 | A1 | 6/2002 |
| WO | WO 2012/108460 | A1 | 8/2012 |
| WO | WO 2012/108461 | A1 | 8/2012 |
| WO | WO 2015/060223 | A1 | 4/2015 |

OTHER PUBLICATIONS

Kurz et al., "Fundamentals of Solidification", Trans Tech Publications Ltd., Switzerland, 1998, p. 256, total 17 pages.

Written Opinion of the International Searching Authority for PCT/JP2016/084977 (PCT/ISA/237) dated Feb. 14, 2017.

Chinese Office Action and Search report dated Jul. 26, 2019, for counterpart Chinese Application No. 201680069891.3, with English translation.

Korean Office Action dated Aug. 1, 2019, for counterpart Application No. 10-2018-7016250, with English translation.

Extended European Search Report, dated Apr. 18, 2019, for counterpart European Application No. 16868674.9.

* cited by examiner

STEEL, CARBURIZED STEEL COMPONENT, AND METHOD FOR MANUFACTURING CARBURIZED STEEL COMPONENT

TECHNICAL FIELD OF THE INVENTION

The present invention relates to a steel, a carburized steel component, and a method for manufacturing a carburized steel component.

Priority is claimed on Japanese Patent Application No. 2015-232117, filed on Nov. 27, 2015, the content of which is incorporated herein by reference.

RELATED ART

Generally, Mn, Cr, Mo, Ni, and the like are added in a combination to steels used for components for machine structural use. A steel for carburizing having such a chemical composition and being manufactured via processes such as casting, forging, and rolling is subjected to machining such as forging and cutting, and is then subjected to heat treatment such as carburizing. Accordingly, it is possible to obtain a carburized steel component including a carburized layer that is a hard layer in a surface layer area, and a steel portion that is a base metal which has not been affected by carburizing treatment.

Cutting related cost is very high in the cost of manufacturing carburized steel components. Due to not only expensive cutting tools but also a large amount of generated cutting chips, cutting is disadvantageous even from a viewpoint of a yield. Therefore, attempts have been made to replace cutting with forging.

Forging can be broadly classified into hot forging, warm forging, and cold forging. Warm forging is characterized in that a small amount of scale is generated and components can be manufactured with dimensional accuracy higher than that of hot forging. In addition, cold forging is characterized in that no scale is generated, dimensional accuracy is much higher, and a level close to that of cutting is achieved. Therefore, a component manufacturing method in which finishing is performed through cold forging after rough working is performed through hot forging, a component manufacturing method in which low-level cutting is performed as finishing after warm forging is performed, a component manufacturing method in which forming is performed through only cold forging, and the like have been examined.

However, in replacing cutting with warm forging or cold forging, when a steel for carburizing has significant deformation resistance, contact pressure applied to a forming tool increases, so that the life span of the forming tool is degraded. In this case, due to an increase in cost for the forming tool, the cost benefit of cutting decreases. On the other hand, in a case where a steel is formed into a complicated shape, there is a problem such as a crack occurring in a part where heavy working is applied. Accordingly, various technologies have been examined in order to achieve softening of a steel for carburizing and to improve a critical compression ratio.

For example, Patent Document 1 and Patent Document 2 disclose a steel for carburizing, in which softening of the steel for carburizing is achieved by reducing the amounts of C, Si and Mn, and cold forgeability is improved. Patent Document 3 discloses a steel for carburizing, in which density of fine Ti-based precipitates is controlled by reducing the C content and an increase in hardness of a material is suppressed so that excellent cold forgeability and crystal coarsening preventing characteristics are achieved. In both cases, cold forgeability is improved by reducing the C content. In this specification, cold forgeability is evaluated based on deformation resistance and the critical compression ratio at the time of cold forging.

Although cold forging is characterized by dimensional accuracy close to that of cutting, depending on the component being subjected to cold forging, a cutting process is included in no small measure. That is, a steel to be subjected to cold forging is required to be improved in not only the cold forgeability but also machinability.

In Patent Document 1 and Patent Document 3, machinability after cold forging is not mentioned, and an effect of improving machinability is unclear. In Patent Document 2, Al is solid-solubilized in a steel by containing a large amount of Al, and $Al_2O_3$ serves as protective coating for a tool so that the life span of the tool is improved. However, this technology does not improve cutting chip disposability. Therefore, in a case where the steel disclosed in Patent Document 2 is subjected to cutting, cutting chips are elongated, and there is concern that cutting chips are entwined around a product or the tool and a processing device stops.

In order to suppress the wear amount of a tool and to enhance cutting chip disposability, there is a need to increase the S content. However, when the S content increases, a large amount of coarse sulfides are generated and cold forgeability is degraded. That is, when the S content increases in amount in order to enhance machinability, an effect of improving a critical compression ratio due to softening of a steel for carburizing is offset.

PRIOR ART DOCUMENT

Patent Document

[Patent Document 1] Japanese Patent No. 5135562
[Patent Document 2] Japanese Patent No. 5135563
[Patent Document 3] Japanese Patent No. 5458048

Non-Patent Document

[Non-Patent Document 1] "Fundamentals of Solidification", written by W. Kurz and D. J. Fisher, Trans Tech Publications Ltd., (Switzerland), 1998, p. 256

DISCLOSURE OF THE INVENTION

Problems to be Solved by the Invention

As described above, cost of cutting takes a large proportion of the cost of manufacturing high strength components for machine structural use. In order to reduce the cost of cutting, it is desired to improve both cutting workability and cold forgeability of steels which are materials of high strength components for machine structural use. When the cutting workability of steels is improved, a cutting process is made efficient. When the cold forgeability of steels is improved, a part of the cutting process can be replaced with cold forging which can be carried out at comparatively low cost. However, according to a technology in the related art, it has been necessary to add sulfides serving as a machinability imparting element to a steel in order to improve cutting workability. The sulfides increase deformation resistance of a steel and decrease a critical compression ratio of a steel, thereby impairing cold forgeability of the steel. In the chemical composition of a steel, in a case where the amounts of alloying elements such as C, Si and Mn are reduced, although cold forgeability of the steel can be improved while machinability of the steel is maintained, hardenability of the steel is degraded. Accordingly, it is not possible to ensure the strength necessary for components for machine structural use.

The present invention has been made in consideration of the foregoing circumstances, and an object thereof is to provide a steel which has excellent cold forgeability due to small deformation resistance and a high critical compression ratio compared to a steel in the related art and has machinability improved without impairing the deformation resistance in a stage before carburizing or carbonitriding, and which can be highly strengthened through the carburizing or the carbonitriding; a high strength carburized steel component which is obtained using the steel; and a method for manufacturing a carburized steel component.

Means for Solving the Problem

The gist of the present invention is as follows.

(1) According to an aspect of the present invention, there is provided a steel, in which a chemical composition includes, by mass %, C: 0.07% to 0.13%, Si: 0.0001% to 0.50%, Mn: 0.0001% to 0.80%, S: 0.0050% to 0.0800%, Cr: more than 1.30% to 5.00% or less, B: 0.0005% to 0.0100%, Ti: 0.020% or more to less than 0.100%, Al: 0.010% to 0.100%, Bi: more than 0.0001% to 0.0100% or less, N: 0.0080% or less, P: 0.050% or less, O:0.0030% or less, Nb: 0% to 0.100%, V: 0% to 0.20%, Mo: 0% to 0.500%, Ni: 0% to 1.000%, Cu: 0% to 0.500%, Ca: 0% to 0.0030%, Mg: 0% to 0.0030%, Te: 0% to 0.0030%, Zr: 0% to 0.0050%, a rare earth metal: 0% to 0.0050%, Sb: 0% to 0.0500%, and a remainder including Fe and impurities. A hardenability index Ceq obtained by substituting the amount of each element in the chemical composition indicated by mass % in Expression 1 ranges from greater than 7.5 to smaller than 44.0. A metallographic structure includes ferrite ranging from 85 to 100 area %. The average distance between sulfides, which are observed in a cross section parallel to a rolling direction of the steel and have an equivalent circle diameter ranging from 1 μm or greater to smaller than 2 μm, is shorter than 30.0 μm. The presence density of the sulfides, which are observed in the cross section parallel to the rolling direction of the steel and have an equivalent circle diameter ranging from 1 μm or greater to smaller than 2 μm, is 300 pieces/mm$^2$ or more.

$$Ceq=(0.7\times Si+1)\times(5.1\times Mn+1)\times(2.16\times Cr+1)\times(3\times Mo+1)\times(0.3633\times Ni+1) \quad \text{(Expression 1)}$$

(2) In the steel according to (1), the chemical composition may include, by mass %, one or more selected from the group consisting of Nb: 0.002% to 0.100%, V: 0.002% to 0.20%, Mo: 0.005% to 0.500%, Ni: 0.005% to 1.000%, Cu: 0.005% to 0.500%, Ca: 0.0002% to 0.0030%, Mg: 0.0002% to 0.0030%, Te: 0.0002% to 0.0030%, Zr: 0.0002% to 0.0050%, a rare earth metal: 0.0002% to 0.0050%, and Sb: 0.0020% to 0.0500%.

(3) According to another aspect of the present invention, there is provided a carburized steel component including a steel portion, and a carburized layer which is a region on an outer surface of the steel portion and which has Vickers hardness of HV 550 or higher. The thickness of the carburized layer ranges from greater than 0.40 mm to smaller than 2.00 mm. The average Vickers hardness at a position in a depth of 50 μm from a surface of the carburized steel component ranges from HV 650 or higher to HV 1,000 or lower. The average Vickers hardness at a position in a depth of 2.0 mm from the surface of the carburized steel component ranges from HV 250 or higher to HV 500 or lower. A chemical composition of the steel portion includes, by mass %, C: 0.07% to 0.13%, Si: 0.0001% to 0.50%, Mn: 0.0001% to 0.80%, S: 0.0050% to 0.0800%, Cr: more than 1.30% to 5.00% or less, B: 0.0005% to 0.0100%, Ti: 0.020% or more to less than 0.100%, Al: 0.010% to 0.100%, Bi: more than 0.0001% to 0.0100% or less, N: 0.0080% or less, P: 0.050% or less, O:0.0030% or less, Nb: 0% to 0.100%, V: 0% to 0.20%, Mo: 0% to 0.500%, Ni: 0% to 1.000%, Cu: 0% to 0.500%, Ca: 0% to 0.0030%, Mg: 0% to 0.0030%, Te: 0% to 0.0030%, Zr: 0% to 0.0050%, a rare earth metal: 0% to 0.0050%, Sb: 0% to 0.0500%, and a remainder including Fe and impurities. A hardenability index Ceq obtained by substituting the amount of each element in the chemical composition of the steel portion indicated by mass % in Expression 2 ranges from greater than 7.5 to smaller than 44.0. The average distance between sulfides, which are observed in a cross section parallel to a rolling direction of the carburized steel component and have an equivalent circle diameter in the steel portion ranging from 1 μm or greater to smaller than 2 μm, is shorter than 30.0 μm. The presence density of the sulfides, which are observed in the cross section parallel to the rolling direction of the carburized steel component and have an equivalent circle diameter in the steel portion ranging from 1 μm or greater to smaller than 2 μm, is 300 pieces/mm$^2$ or more.

$$Ceq=(0.7\times Si+1)\times(5.1\times Mn+1)\times(2.16\times Cr+1)\times(3\times Mo+1)\times(0.3633\times Ni+1) \quad \text{(Expression 2)}$$

(4) In the carburized steel component according to (3), the chemical composition of the steel portion may include, by mass %, one or more selected from the group consisting of Nb: 0.002% to 0.100%, V: 0.002% to 0.20%, Mo: 0.005% to 0.500%, Ni: 0.005% to 1.000%, Cu: 0.005% to 0.500%, Ca: 0.0002% to 0.0030%, Mg: 0.0002% to 0.0030%, Te: 0.0002% to 0.0030%, Zr: 0.0002% to 0.0050%, a rare earth metal: 0.0002% to 0.0050%, and Sb: 0.0020% to 0.0500%.

(5) According to still another aspect of the present invention, there is provided a method for manufacturing the carburized steel component according to (3) or (4). The method for manufacturing a carburized steel component includes cold plastic working the steel according to (1) or (2), cutting the steel after the cold plastic working, and carburizing or carbonitriding the steel after the cutting.

(6) The method for manufacturing the carburized steel component, according to (5) may further include quenching, or quenching and tempering after the carburizing or the carbonitriding.

Effects of the Invention

The steel according to the present invention has excellent cold forgeability due to small deformation resistance and a high critical compression ratio at the time of cold forging compared to a steel in the related art and also has excellent machinability in a stage before carburizing treatment or carbonitriding treatment. In addition, according to the present invention, it is possible to provide a carburized steel component which can be inexpensively manufactured and has high strength, and a method for manufacturing the same.

EMBODIMENT OF THE INVENTION

Figure 1:
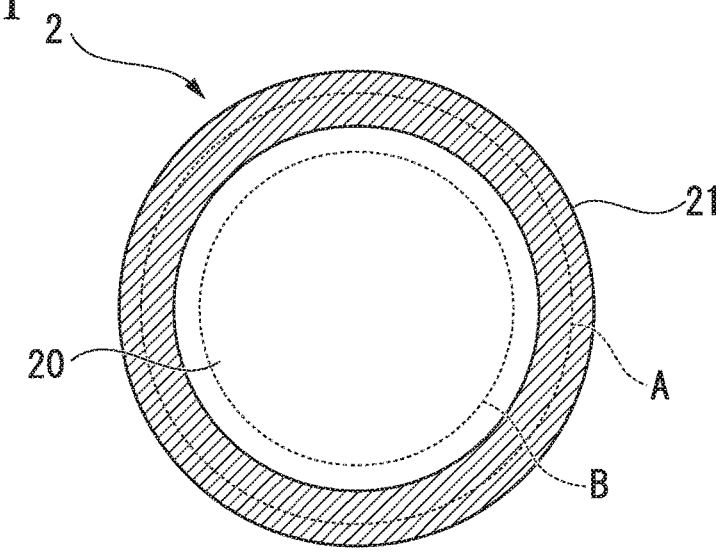
FIG. 1 is a cross-sectional view of a carburized steel component according to an aspect of the present invention.

Hereinafter, the present invention will be described in detail. First, a steel (steel for carburizing) according to an embodiment of the present invention will be described.

The inventors have intensively examined a steel for carburizing which has small deformation resistance, a high critical compression ratio, and high machinability in a stage before carburizing or carbonitriding, and which can form a hard layer and a steel portion exhibiting strength equal to that of a steel in the related art through the carburizing or the carbonitriding. As a result, the following knowledge has been acquired.

According to a technology in the related art, in order to suppress the wear amount of a tool and to improve cutting chip disposability, it has been necessary to add a large amount of S to a steel for carburizing. S becomes sulfides in a steel for carburizing, and these sulfides serve as a machinability imparting element. However, a large amount of S generates a large amount of coarse sulfides in a steel for carburizing, thereby degrading cold forgeability of the steel for carburizing. The inventors have examined a method for achieving high machinability by means of a minute amount of S. As a result, the inventors have found that reducing the size of sulfides using a minute amount of Bi and increasing the density of sulfides are effective in improving cold forgeability and machinability.

The inventors have performed various experiments regarding a relationship between the equivalent circle diameter and the density of sulfides, and the wear amount of a tool and the cutting chip disposability. As a result, the inventors have found that wear of a tool is suppressed in a case where the presence density of sulfides which are observed in a cross section parallel to a rolling direction of a steel for carburizing and have an equivalent circle diameter ranging from 1 μm or greater to smaller than 2 μm is 300 pieces/$mm^2$ or more. Since sulfides serve as a lubricant between a cutting tool and a steel, the sulfides have an effect of suppressing wear of the cutting tool. However, it is estimated that in a case where there is a small amount of sulfides and the sulfides are coarse in diameter, distribution of the sulfides is no longer uniform and a region lacking in a lubricating effect is generated on a surface of a cutting tool. Meanwhile, it is estimated that in a case where the presence density of sulfides which are observed in a cross section parallel to the rolling direction and have an equivalent circle diameter ranging from 1 μm or greater to smaller than 2 μm is 300 pieces/$mm^2$ or more, coarse sulfides having an equivalent circle diameter of greater than 2 μm are restrained from being generated, and sulfides in a steel are uniformly distributed throughout a surface of a cutting tool at the time of cutting, so that a high lubricating effect can be achieved even with a small amount of sulfides.

Moreover, the inventors have found that cutting chip disposability is improved in a case where the average distance between sulfides which are observed in a cross section parallel to the rolling direction of a steel for carburizing and have an equivalent circle diameter of 1 μm or greater is shorter than 30.0 μm. Since sulfides serve as breaking origins of cutting chips generated at the time of cutting, the sulfides have an effect of shortening the length of cutting chips and improving cutting chip disposability. However, it is estimated that in a case where there is a small amount of sulfides and the distribution thereof is not uniform, long cutting chips are likely to be generated in a region where the sulfides are roughly distributed. Meanwhile, it is estimated that in a case where the average distance between sulfides which are observed in a cross section parallel to the rolling direction and have an equivalent circle diameter of 1 μm or greater is shorter than 30.0 μm, long cutting chips can be restrained from being generated, with a small amount of sulfides compared to that of a steel in the related art.

Meanwhile, in a case where sulfides are finely dispersed as described above, the cold forgeability of a steel for carburizing is also improved. In a case where sulfides are coarse, the sulfides serve as origins of a crack at the time of cold forging of a steel for carburizing and generate a crack. However, if sulfides are refined as described above, the sulfides do not serve as the origins of a crack any longer.

Moreover, the inventors have found that in a case where a steel contains a minute amount of Bi, sulfides in the steel can be finely dispersed as described above and machinability after cold forging of the steel is improved while deformation resistance at the time of cold forging remains small. The reason that sulfides are finely dispersed due to a minute amount of Bi is considered to be as follows.

Sulfides are often crystallized before solidification of a molten steel or at the time of solidification of a molten steel, and the size of sulfides is considerably affected by the cooling rate at the time of solidification of a molten steel. In addition, the solidification structure of a continuously cast slab generally exhibits a form of dendrite, and the dendrite is formed due to diffusion of a solute element in a solidification process. The solute element is concentrated in portions among branches of dendrite. Since Mn tends to be concentrated in portions among branches, sulfides are mainly crystallized in portions among branches of dendrite.

In order to cause sulfides to be finely dispersed, there is a need to shorten the spacing among branches of dendrite. The primary arm spacing of dendrite has been investigated in the related art (for example, Non-Patent Document 1), and it can be expressed by the following Expression A.

$$\lambda \propto (D \times \delta \times \Delta T)^{0.25} \quad \text{(Expression A)}$$

Here, λ indicates the primary arm spacing of dendrite (μm), D indicates the diffusion coefficient ($m^2/s$), δ indicates the solid-liquid interface energy ($J/m^2$), and ΔT indicates the solidification temperature range (° C.).

From the Expression A, it is understood that the primary arm spacing λ of dendrite depends on the solid-liquid interface energy δ, and λ decreases if the δ can be reduced. If λ can decrease, the size of sulfides crystallized among dendrite branches can be reduced. The inventors have estimated that the solid-liquid interface energy δ is reduced due to Bi, and reducing the primary arm spacing of dendrite and refining sulfides are thereby realized.

Here, the above-described effect of refining sulfides due to Bi is achieved in a case where the Bi content ranges from more than 0.0001 by mass % to 0.0100 by mass % or less. There is no precedent for examination on a relationship between such a minute amount of Bi and the degree of dispersion of sulfides. There are cases where Bi of approximately 0.1 by mass % or more is used as a machinability imparting element. However, Bi of less than 0.1 by mass % does not sufficiently have an effect of improving machinability and impairs hot workability of a steel, thereby being generally disregarded. Meanwhile, in the steel for carburizing according to the present embodiment, a machinability imparting element is sulfide, and Bi is used for improving the effect of the sulfide, i.e. strengthening machinability.

Therefore, in the steel for carburizing according to the present embodiment, both cold forgeability and machinability are enhanced due to a synergistic effect of a minute amount of Bi and sulfides.

The constitution of the steel for carburizing of the present embodiment obtained based on the foregoing knowledge of the inventors will be specifically described below.

[Chemical Composition of Steel for Carburizing]

First, the amount of each composition element, which compose the chemical composition of the steel for carburizing of the present embodiment, will be described. The unit "%" in the amount of each composition element denotes "by mass %". Since the steel for carburizing of the present embodiment has a constitution in common with the steel portion (part not affected by carburizing) of a carburized steel component according to another embodiment of the present invention, there are cases where the steel portion is also described therewith.

C: 0.07% to 0.13%

Carbon (C) is included in order to ensure the hardness of the steel portion of a carburized steel component including a carburized layer and the steel portion. As described above, the C content in a steel for carburizing in the related art is approximately 0.2%. However, in the steel for carburizing and the steel portion in the carburized steel component according to the present embodiment, the C content is limited to 0.13% or less which is less than that in the related art. The reason is that when the C content exceeds 0.13%, hardness of a steel for carburizing before forging increases prominently and the critical compression ratio also decreases, so that cold forgeability of the steel for carburizing is impaired. However, when the C content is less than 0.07%, even if it is attempted to increase hardenability as much as possible by containing large amounts of the below-described alloying elements for enhancing hardenability, the hardness of the steel portion of the carburized steel component cannot be equivalent to the level of a steel for carburizing in the related art. Therefore, there is a need to control the C content within a range from 0.07% to 0.13%. The lower limit value for the C content is preferably 0.08%. The preferable upper limit value for the C content is 0.12%, 0.11%, or 0.10%.

Si: 0.0001% to 0.50%

Silicon (Si) is an element of improving fatigue strength by prominently increasing resistance to temper softening of a low-temperature-tempered martensite steel such as a carburized steel component. In order to achieve this effect, the Si content needs to be 0.0001% or more. However, when the Si content exceeds 0.50%, hardness of a steel for carburizing before forging increases, deformation resistance increases, and then the critical compression ratio decreases, so that cold forgeability of the steel for carburizing is impaired. Therefore, the Si content needs to be controlled within a range from 0.0001% to 0.50%. In a case of laying emphasis on tooth surface fatigue strength of a carburized steel component, the Si content is increased within this range. In a case of laying emphasis on ensuring cold forgeability of a steel for carburizing, that is, reducing deformation resistance or improving marginal workability, the Si content is decreased within this range. In a case of laying emphasis on tooth surface fatigue strength of a carburized steel component, the Si content is preferably set to 0.10% or more. In a case of laying emphasis on ensuring cold forgeability of a steel for carburizing, the Si content is preferably set to 0.20% or less. The lower limit value for the Si content may be set to 0.01%, 0.05%, or 0.15%. The upper limit value for the Si content may be set to 0.37%, 0.35%, or 0.30%.

Mn: 0.0001% to 0.80%

Manganese (Mn) is an element of enhancing hardenability of a steel. In order to enhance strength of a carburized steel component after carburizing heat treatment by means of this effect, the Mn content needs to be 0.0001% or more. However, when the Mn content exceeds 0.80%, hardness of a steel for carburizing before forging increases, deformation resistance increases, and then the critical compression ratio decreases, so that cold forgeability of the steel for carburizing is impaired. Therefore, the Mn content needs to be controlled within a range from 0.0001% to 0.80%. The lower limit value for the Mn content may be set to 0.04%, 0.10%, or 0.25%. The upper limit value for the Mn content may be set to 0.60%, 0.50%, or 0.45%.

S: 0.0050% to 0.0800%

Sulphur (S) is an element combining with Mn and the like in a steel, forming sulfides such as MnS, and improving machinability of a steel. In order to achieve this effect, the S content needs to be set to 0.0050% or more. However, when the S content exceeds 0.0800%, sulfides become origins and generate a crack at the time of forging, so that the critical compression ratio of a steel sometimes decreases. Therefore, the S content needs to be controlled within a range from 0.0050% to 0.0800%. The preferable lower limit value for the S content is 0.0080%, 0.0090%, or 0.0100%. The preferable upper limit value for the S content is 0.0700%, 0.0500%, or 0.0200%.

Cr: More than 1.30% to 5.00% or Less

Chromium (Cr) is an element enhancing hardenability of a steel. In order to enhance strength of a carburized steel component after carburizing heat treatment by means of this effect, the Cr content needs to be more than 1.30%. However, when the Cr content exceeds 5.00%, the hardness of a steel for carburizing before forging increases, deformation resistance increases, and then the critical compression ratio decreases, so that cold forgeability of the steel for carburizing is impaired. Therefore, the Cr content needs to be controlled within a range from more than 1.30% to 5.00% or less. In addition, compared to other elements such as Mn, Mo, and Ni having an effect of improving hardenability, Cr increases hardness of a steel for carburizing (steel before carburizing heat treatment) to a small extent and has a comparatively significant effect of improving hardenability (hardness increased through quenching, that is, carburizing heat treatment). Thus, the steel for carburizing and the steel portion in the carburized steel component according to the present embodiment include the Cr content more than that in a steel for carburizing in the related art. The preferable lower limit value for the Cr content is 1.35%, 1.50%, 1.60%, or 1.80%. The preferable upper limit value for the Cr content is 4.50%, 3.50%, 2.50%, or 2.20%.

B: 0.0005% to 0.0100%

Boron (B) is an element considerably enhancing hardenability of a steel even with a minute amount in a case of being solid-solubilized in austenite. Boron can enhance strength of a carburized steel component after carburizing heat treatment by means of this effect. In addition, since there is no need to add a large amount in order to achieve the above-described effect, B is characterized in that hardness of a steel for carburizing before forging is rarely increased. Therefore, in the steel for carburizing and the steel portion in the carburized steel component according to the present embodiment, B is actively utilized. When the B content is less than 0.0005%, the above-described effect of improving hardenability cannot be achieved. Meanwhile, when the B content exceeds 0.0100%, the above-described effect is saturated. Therefore, the B content needs to be controlled within a range from 0.0005% to 0.0100%. The lower limit value for the B content is preferably set to 0.0010% or 0.0015%. The upper limit value for the B content is preferably set to 0.0045%, 0.0025%, or 0.0020%. In a case where a certain amount or more of N is present in a steel, B combines with N and forms BN, so that the amount of a solute B decreases. As a result, there are cases where the effect of enhancing hardenability cannot be achieved. Thus, in the steel for carburizing of the present embodiment, there is a need for the amount of Ti for fixing N to be set to a predetermined value or greater.

Al: 0.010% to 0.100%

Al is an element having deoxidizing action. At the same time, Al combines with N, is likely to form AlN, and is effective in preventing austenite grains from being coarsened at the time of carburizing heating. However, when the Al content is less than 0.010%, austenite grains cannot be stably prevented from being coarsened. In a case where austenite grains are coarsened, bending fatigue strength of a carburized steel component is degraded. Meanwhile, when the Al content exceeds 0.100%, coarse oxides are likely to be formed, and bending fatigue strength of the carburized steel component is degraded. Therefore, the Al content is set to range from 0.010% to 0.100%. The preferable lower limit value for the Al content is 0.015%, 0.030%, or 0.035%. The preferable upper limit value for the Al content is 0.090%, 0.060%, or 0.055%.

Ti: 0.020% or more to less than 0.100%

Titanium (Ti) is an element having an effect of fixing N in a steel as TiN. When Ti is added, BN is prevented from being formed, and the amount of a solute B which contributes to hardenability is ensured. In addition, when Ti is stoichiometrically excessive with respect to N, TiC is formed. This TiC has an austenite pinning effect of preventing grains at the time of carburizing from being coarsened. When the Ti content is less than 0.020%, an effect of improving hardenability due to B cannot be achieved, and grains at the time of carburizing cannot be prevented from being coarsened. Meanwhile, when the Ti content becomes 0.100% or more, due to an excessive precipitation amount of TiC, hardness of a steel for carburizing before forging increases, deformation resistance increases, and then the critical compression ratio decreases, so that cold forgeability of the steel for carburizing is impaired. Therefore, the Ti content needs to be controlled within a range from 0.020% or more to less than 0.100%. The lower limit value for the Ti content is preferably 0.025%, 0.030%, or 0.040%. The upper limit value for the Ti content is preferably 0.090%, 0.080%, 0.070%, 0.060%, or 0.050%.

Bi: More than 0.0001% to 0.0100% or Less

Bi is an important element in the steel for carburizing according to the present embodiment. Since the dendrite structure is refined at the time of solidification of a molten steel due to a minute amount of Bi, sulfides are finely dispersed. In order to achieve an effect of refining sulfides, the Bi content needs to be more than 0.0001%. However, when the Bi content exceeds 0.0100%, the hot workability of a steel deteriorates, and it is difficult to perform hot rolling. From these circumstances, in the steel for carburizing according to the present embodiment, the Bi content is set to range from more than 0.0001% to 0.0100% or less. In order to reliably improve machinability and to achieve an effect of finely dispersing sulfides, the Bi content is preferably set to 0.0010% or more, or 0.0015% or more. Meanwhile, the preferable upper limit value for the Bi content is 0.0095%, 0.0090%, or 0.0050%.

In addition to the base elements described above, the steel for carburizing and the steel portion in the carburized steel component according to the present embodiment contain impurities. Here, impurities denote auxiliary raw materials such as scraps, and elements such as N, P, and O incorporated during a manufacturing process. In order to sufficiently exhibit the effect of the steel for carburizing of the present embodiment, N, P, and O need to be controlled as follows. Since the above-described impurities are not necessary in order to achieve the object of the steel for carburizing of the present embodiment, the lower limit values for the amounts of the above-described impurities are 0%.

N: 0.0080% or Less

Nitrogen (N) is an impurity, which is an element forming BN and reducing the amount of a solute B. In a case where the N content exceeds 0.0080%, even if Ti is added, N which is not fixed by Ti is generated in a steel, so that it is not possible to ensure the solute B which contributes to hardenability. In addition, in a case where the N content exceeds 0.0080%, coarse TiN is formed and becomes an origin of a crack at the time of forging, so that the critical compression ratio of a steel for carburizing before forging decreases. Therefore, the N content needs to be limited to 0.0080% or less. Since a lower N content is more desirable, the lower limit value for the N content is 0%. However, in consideration of the manufacturing cost, the lower limit value for the N content may be set to 0.0030%. In addition, the upper limit value for the N content may be set to 0.0075%, 0.0060%, 0.0055%, or 0.0050%. In a general operational condition, the N content is approximately 0.0060%.

P: 0.050% or Less

Phosphorus (P) is an impurity. Fatigue strength or hot workability of a steel is degraded due to P. Therefore, a lower P content is more preferable. The lower limit value for the P content is 0%. However, in consideration of the manufacturing cost, the lower limit value for the P content may be set to 0.0002% or 0.0005%. Meanwhile, the range of 0.050% or less is allowed for the P content. The P content is preferably set to 0.045% or less and is more preferably set to 0.035% or less, 0.020% or less, or 0.015% or less.

O: 0.0030% or Less

Oxygen (O) is an impurity, which is an element forming oxide-based inclusions. When the O content exceeds 0.0030%, significant inclusions which will become origins of fatigue fracture increases, causing degradation of fatigue properties. Therefore, the O content needs to be limited to 0.0030% or less. The O content is preferably set to 0.0015% or less. Since a lower O content is more desirable, the lower limit value for the O content is 0%. However, in consideration of the manufacturing cost, the lower limit value for the O content may be set to 0.0007% or 0.0010%. Meanwhile, the upper limit value for the O content may be set to 0.0025%, 0.0020%, or 0.0015%. In a general operational condition, the amount of O is approximately 0.0020%.

In addition to the base elements and the impurity element described above, the steel for carburizing and the steel portion in the carburized steel component according to the present embodiment may further contain at least one of Nb, V, Mo, Ni, Cu, Ca, Mg, Te, Zr, REM, and Sb as an optional element, in place of Fe, that is, a remainder of the chemical composition. However, these optional elements are not essential to achieve the object of the steel for carburizing of the present embodiment, the lower limit values for the amounts of these optional elements are 0%. The values disclosed in the specification of this application as the lower limit values for the amounts of the optional elements are all examples of preferable values. Hereinafter, numerical limitation ranges of the optional elements and the reason for limitation will be described.

Among the optional elements described above, Nb and V have an effect of preventing the structure from being coarsened.

Nb: 0.002% to 0.100%

Niobium (Nb) is an element combining with N and C in a steel and forming Nb (C and N). This Nb (C and N) suppresses granular growth by pinning grain boundaries of austenite, thereby preventing the structure from being coarsened. The above-described effect can be achieved when the Nb content is set to 0.002% or more, which is preferable. When the Nb content exceeds 0.100%, the above-described effect is saturated. Therefore, the Nb content is preferably set to 0.002% to 0.100%. The lower limit value for the Nb content is more preferably set to 0.010%. In addition, the upper limit value for the Nb content is more preferably set to 0.050%, 0.010%, 0.005%, or 0.004%.

V: 0.002% to 0.20%

Vanadium (V) is an element combining with N and C in a steel and forming V (C and N). This V (C and N) suppresses granular growth by pinning grain boundaries of austenite, thereby preventing the structure from being coarsened. The above-described effect can be achieved when the V content is set to 0.002% or more, which is preferable. When the V content exceeds 0.20%, the above-described effect is saturated. Therefore, the V content is preferably set to 0.002% to 0.20%. The lower limit value for the V content is more preferably set to 0.05%. The upper limit value for the V content is more preferably set to 0.10%.

Among the optional elements described above, Mo, Ni, and Cu have effects of enhancing hardenability of a steel and thereby enhancing strength of a carburized steel component after a carburizing heat treatment.

Mo: 0.005% to 0.500%

Molybdenum (Mo) is an element enhancing hardenability of a steel. When the Mo content is set to 0.005% or more, strength of a carburized steel component after carburizing heat treatment can be enhanced by means of this effect, which is preferable. In addition, Mo is an element which does not form oxides in the atmosphere of gas carburizing and is unlikely to form nitrides. In a case where Mo is contained in a steel for carburizing, an oxide layer, a nitride layer, or an abnormal carburizing layer caused thereby are prevented from forming on a surface of a carburized layer. However, Mo is expensive. Furthermore, when the Mo content exceeds 0.500%, the hardness of a steel for carburizing before forging increases, the deformation resistance increases, and then the critical compression ratio decreases, so that cold forgeability of the steel for carburizing is impaired. Therefore, the Mo content is preferably set to 0.005% to 0.500%. The upper limit value for the Mo content may be more preferably set to 0.200%, 0.100%, 0.010%, or 0.006%.

Ni: 0.005% to 1.000%

Nickel (Ni) is an element which enhances the hardenability of a steel. When the Ni content is set to 0.005% or more, the strength of a carburized steel component after carburizing heat treatment can be enhanced by means of this effect, which is preferable. In addition, Ni is an element which does not form oxides and nitrides in the atmosphere of atmospheric gas of gas carburizing. In a case where Ni is contained in a steel for carburizing, an oxide layer, a nitride layer, or an abnormal carburizing layer caused thereby are prevented from forming on a surface of a carburized layer. However, Ni is expensive. Furthermore, when the Ni content exceeds 1.000%, hardness of a steel for carburizing before forging increases, deformation resistance increases, and then the critical compression ratio decreases, so that cold forgeability of the steel for carburizing is impaired. Therefore, the Ni content is preferably set to 0.005% to 1.000%. The lower limit value for the Ni content may be more preferably set to 0.050%. In addition, the upper limit value for the Ni content may be set to 0.700%, 0.600%, or 0.500%.

Cu: 0.005% to 0.500%

Copper (Cu) is an element enhancing hardenability of a steel. When the Cu content is set to 0.005% or more, strength of a carburized steel component after carburizing heat treatment can be enhanced by means of this effect, which is preferable. In addition, Cu is an element which does not form oxides and nitrides in the atmosphere of atmospheric gas of gas carburizing. In a case where Cu is contained in a steel for carburizing, an oxide layer, a nitride layer, or an abnormal carburizing layer caused thereby are prevented from forming on a surface of a carburized layer. However, when the Cu content exceeds 0.500%, ductility of a steel in a high temperature range of 1,000° C. or higher is degraded, and the yield at the time of rolling and continuous casting are degraded. In addition, when the Cu content exceeds 0.500%, the hardness of a steel for carburizing before forging increases, deformation resistance increases, and then the critical compression ratio decreases, so that cold forgeability of the steel for carburizing is impaired. Therefore, the Cu content is preferably set to 0.005% to 0.500%. The lower limit value for the Cu content may be more preferably set to 0.050%. Meanwhile, the upper limit value for the Cu content may be set to 0.300% or 0.006%. In a case where the steel contains Cu, in order to improve the above-described ductility in a high temperature range, it is desirable that the Ni content is ½ the Cu content or more by mass %.

Among the optional elements described above, Ca, Mg, Te, Zr, REM, and Sb have an effect of improving machinability.

Ca: 0.0002% to 0.0030%

Calcium (Ca) is an element having an effect of controlling the form of sulfides, for example, causing sulfides to have a spheroidal shape without being stretched. In a case where the steel contains Ca, anisotropy of the shapes of sulfides is improved, and degradation of mechanical properties due to sulfides is further suppressed. In addition, Ca is an element forming protective coating on a surface of a cutting tool at the time of cutting and improving machinability. These effects can be achieved when the Ca content is set to 0.0002% or more, which is preferable. Meanwhile, when the Ca content exceeds 0.0030%, there are cases where coarse oxides, sulfides, and the like are formed and exert an adverse influence on fatigue strength of a carburized steel component. Therefore, the Ca content is preferably set to range from 0.0002% to 0.0030%. The lower limit value for the Ca content may be more preferably set to 0.0008%. The upper limit value for the Ca content may be set to 0.0020% or 0.0003%.

Mg: 0.0002% to 0.0030%

Magnesium (Mg), similar to Ca, is an element controlling the form of sulfides and forming protective coating on a surface of a cutting tool at the time of cutting as well, thereby improving machinability. These effects can be achieved when the Mg content is set to 0.0002% or more, which is preferable. Meanwhile, when the Mg content exceeds 0.0030%, there are cases where coarse oxides are formed and exert an adverse influence on fatigue strength of a carburized steel component. Therefore, the Mg content is preferably set to range from 0.0002% to 0.0030%. The lower limit value for the Mg content may be more preferably set to 0.0008%. The upper limit value for the Mg content may be set to 0.0020% or 0.0012%.

Te: 0.0002% to 0.0030%

Tellurium (Te) is an element controlling the form of sulfides. This effect can be achieved when the Te content is set to 0.0002% or more, which is preferable. Meanwhile, when the Te content exceeds 0.0030%, embrittlement in hot working of a steel becomes remarkable. Therefore, the Te content is preferably set to range from 0.0002% to 0.0030%. The lower limit value for the Te content may be more preferably set to 0.0008%. The upper limit value for the Te content may be set to 0.0020% or 0.0015%.

Zr: 0.0002% to 0.0050%

Zirconium (Zr) is an element controlling the form of sulfides. This effect can be achieved when the Zr content is set to 0.0002% or more, which is preferable. Meanwhile, when the Zr content exceeds 0.0050%, there are cases where coarse oxides are formed and exert an adverse influence on fatigue strength of a carburized steel component. Therefore, the Zr content is preferably set to range from 0.0002% to 0.0050%. The lower limit value for the Zr content may be more preferably set to 0.0008%. The upper limit value for the Zr content may be set to 0.0030% or 0.0011%.

REM: 0.0002% to 0.0050%

REM (rare earth metals) are an element controlling the form of sulfides. This effect can be achieved when the REM content is set to 0.0002% or more, which is preferable. When the REM content exceeds 0.0050%, there are cases where coarse oxides are formed and exert an adverse influence on fatigue strength of a carburized steel component. Therefore, the REM content is preferably set to range from 0.0002% to 0.0050%. The lower limit value for the REM content may be more preferably set to 0.0008%. The upper limit value for the REM content may be set to 0.0030% or 0.0010%.

REM is the generic term for 17 elements in total including scandium of the atomic number 21 and yttrium of the atomic number 39, in addition to 15 elements from lanthanum of the atomic number 57 to ruthenium of the atomic number 71. Generally, REM is supplied in a form of a misch metal which is a mixture of these elements and is added to a steel. In the present embodiment, the REM content is the total value of the amounts of these elements.

Sb: 0.0020% to 0.0500%

Antimony (Sb) is an element preventing a phenomenon of decarbonizing or carburizing in a manufacturing process of a steel for carburizing (hot rolling, hot forging, annealing, and the like). This effect can be achieved when the Sb content is set to 0.0020% or more, which is preferable. When the Sb content exceeds 0.0500%, there are cases where carburizing properties are impaired at the time of carburizing so that a necessary carburized layer cannot be obtained. Therefore, the Sb content is preferably set to range from 0.0020% to 0.0500%. The lower limit value for the Sb content may be more preferably set to 0.0050%. The upper limit value for the Sb content may be set to 0.0300% or 0.0030%.

As described above, the steel for carburizing of the present embodiment has a chemical composition which includes the basic elements described above and in which the remainder includes iron (Fe) and impurities, or a chemical composition which includes the basic elements described above and one or more selected from the above-described optional elements and in which the remainder includes Fe and impurities.

[Dendrite Structure]

The solidification structure of a continuously cast slab used for manufacturing the steel for carburizing of the present embodiment generally exhibits a form of dendrite. Sulfides in a steel for carburizing are often crystallized before solidification (in a molten steel) or at the time of solidification and is considerably affected by the primary arm spacing of dendrite. That is, when the primary arm spacing of dendrite is small, sulfides crystallized among branchs are small. It is desirable that the primary arm spacing of dendrite in a stage of a slab is shorter than 600 μm in the steel for carburizing of the present embodiment. In the steel for carburizing according to the present embodiment, sulfides are MnS, for example. However, when a slab is subjected to hot working, there are cases where the shape of dendrite changes or the shape of dendrite cannot be discriminated any longer. Therefore, the shape of dendrite in the steel for carburizing of the present embodiment obtained through hot working of a slab is not limited to the above-described range.

In order to finely disperse sulfides in a stable and effective manner, a minute amount of Bi is added and the solid-liquid interface energy in a molten steel is reduced. When the solid-liquid interface energy is reduced, the dendrite structure becomes fine. When the dendrite structure is refined, sulfides crystallized from the primary arm of dendrite are refined.

[Sulfide]

Sulfides (for example, MnS) included in a steel for carburizing are useful for improving machinability of a steel for carburizing. Therefore, there is a need to increase the presence density of sulfides having an appropriate size as much as possible. Meanwhile, although machinability is improved when the S content increases, coarse sulfides increase. Coarse sulfides elongated due to hot rolling or the like impair cold forgeability. Therefore, there is a need to reduce the S content to be lower than the level in the related art and to control the size and the shape of sulfides. Furthermore, in order to improve cutting chip disposability at the time of cutting, sulfides need to be finely dispersed. That is, it is important to reduce the spacing between sulfides.

The presence density of sulfides which are observed in a cross section parallel to the rolling direction of a steel (steel for carburizing) and have an equivalent circle diameter ranging from 1 μm or greater to smaller than 2 μm: 300 pieces/mm$^2$ or more According to the knowledge which the inventors have achieved, when sulfides which are observed in a cross section (L cross section) parallel to the rolling direction of a steel for carburizing and have an equivalent circle diameter ranging from 1 μm or greater to smaller than 2 μm (hereinafter, will be sometimes abbreviated to "fine sulfides") are present in a steel by the presence density of 300 pieces/mm$^2$ or more, wear of a tool is suppressed. The lower limit value for the presence density of fine sulfides may be set to 320 pieces/mm$^2$, 350 pieces/mm$^2$, or 400 pieces/mm$^2$. Although there is no need to regulate the upper limit value for the presence density of fine sulfides, in consideration of the regulation range of the chemical composition and the experimental result, it is estimated that 600 pieces/mm$^2$ will be substantially the upper limit value. The upper limit value for the presence density of fine sulfides may be set to 550 pieces/mm$^2$ or 500 pieces/mm$^2$.

There is concern that sulfides which are observed in the L cross section and have an equivalent circle diameter of less than 1 μm (hereinafter, will be sometimes abbreviated to "super fine sulfides") and sulfides which are observed in the L cross section and have an equivalent circle diameter of 2 μm or greater (hereinafter, will be sometimes abbreviated to "coarse sulfides") do not contribute to the improvement of machinability and also impair cold forgeability. Therefore, a smaller presence density is more favorable. However, in a case where the alloy composition (particularly, the S content) is within the above-described range and the presence density of fine sulfides is within the above-described range, the presence density of coarse sulfides and super fine sulfides is sufficiently reduced. Therefore, there is no need to limit the presence density thereof.

The average distance between sulfides (fine sulfides) which are observed in a cross section parallel to the rolling direction of a steel and have an equivalent circle diameter ranging from 1 μm or greater to smaller than 2 μm: shorter than 30.0 μm In addition, the inventors have performed various experiments regarding a relationship between the average value of distances between fine sulfides (average distance between fine sulfides) and cutting chip disposability. As a result, the inventors have checked that favorable cutting chip disposability can be achieved if the average distance between fine sulfides is shorter than 30.0 μm. Therefore, the average distance between fine sulfides is regulated to be shorter than 30.0 μm. The upper limit value for the average distance between fine sulfides may be set to 27.0 μm, 26.0 μm, or 25.0 μm. The lower limit value for the average distance between fine sulfides is not particularly limited. However, in consideration of the regulation range of the chemical composition and the experimental result, it is estimated that 12.0 μm will be substantially the lower limit value. The lower limit value for the average distance between fine sulfides may be set to 13.0 μm or 14.0 μm.

Coarse sulfides and super fine sulfides are not taken into consideration when the average distance is measured. Since the steel for carburizing according to the present embodiment has a small number of coarse sulfides, there is no need to count coarse sulfides as measurement targets. Since super fine sulfides do not contribute to improvement of cutting chip disposability, super fine sulfides are not counted as measurement targets.

The presence density of fine sulfides is obtained as follows. A steel for carburizing is cut in a direction parallel to the rolling direction. A cut surface is prepared through a routine procedure such that sulfides can be observed. Electromicroscopic photographs of the cut surface in a plurality of measuring locations are captured. Fine sulfides are specified by calculating each equivalent circle diameter of the sulfides included in each electromicroscopic photograph. The presence density of fine sulfides in each measuring location is acquired by dividing the number of fine sulfides included in each electromicroscopic photograph by the area of the visual field of each electromicroscopic photograph. Then, the presence density of fine sulfides is acquired by averaging the obtained values of presence density.

The average distance between fine sulfides is obtained as follows. The centers of gravity of two arbitrary fine sulfides included in each electromicroscopic photograph described above are taken as both ends thereof, and a segment which passes through no fine sulfide except for the two arbitrary fine sulfides is rendered in each electromicroscopic photograph. The average distance between fine sulfides in each measuring location is acquired by acquiring the average value of the lengths of the segments in each electromicroscopic photograph. Then, the average distance between fine sulfides is acquired by further averaging the average distances in each measuring location.

There are cases where a steel includes inclusions which are not sulfides. It may be checked whether or not the inclusions are the sulfides by means of an energy dispersive X-ray spectroscopic analysis apparatus which belongs to an electronic scanning microscope. In addition, the equivalent circle diameter of a sulfide is a diameter of a circle having an area equal to the area of the sulfide and can be acquired through an image analysis. Similarly, the presence density of sulfides and the average distance between sulfides in each measuring location can be acquired through an image analysis executing each of the methods described above. In order to ensure sufficient measurement accuracy, it is preferable to have a large scale of the number of measuring locations and the total area of the measurement visual field (total area of electromicroscopic photographs). In the experiment for realizing the present invention, the inventors have set the number of measuring locations to 25, the magnification of the electromicroscopic photographs to 500-fold, and the total area of the measurement visual field to approximately 1.1 $mm^2$. The location for measurement is not particularly limited. However, it is preferable that the location is in an intermediate region between a surface and the center of a steel for carburizing (in a case where the steel for carburizing is a round bar, a D/4 position). The reason is that an intermediate region between a surface and the center of a steel for carburizing has the average constitution of the steel for carburizing. The inventors have observed sulfides in a cut surface obtained by cutting a round bar at the D/4 position parallel to the axial direction of the round bar.

Since the state of sulfides in a steel for carburizing (a region which becomes a steel portion of a carburized steel component) does not change due to general carburizing, the state of the sulfides in the steel portion of the carburized steel component becomes substantially the same state as the sulfides in the steel for carburizing. The state of the sulfides in the steel portion of the carburized steel component can be specified by a method similar to that of the steel for carburizing.

[Hardenability Index]

Hardenability index Ceq: greater than 7.5 to smaller than 44.0

A hardenability index Ceq obtained by substituting the amount of each element in the chemical composition of the steel for carburizing of the present embodiment indicated by mass % in the following Expression B needs to range from greater than 7.5 to smaller than 44.0. The symbol of element included in Expression B indicates the amount of the element related to the symbol of element thereof by mass %. In a case where Mo and Ni (optional elements) are not included, the hardenability index Ceq may be calculated while the amounts thereof are considered to be 0 by mass %.

$$Ceq=(0.7\times Si+1)\times(5.1\times Mn+1)\times(2.16\times Cr+1)\times(3\times Mo+1)\times(0.3633\times Ni+1) \quad \text{(Expression B)}$$

The inventors performed carburizing and quenching under the same condition of carburizing heat treatment with respect to various kinds of steels for carburizing having chemical compositions within the above-described range and having hardenability indexes Ceq different from each other, and have measured hardness of the carburized layer and the effective case depth (depth of a region having a Vickers hardness of HV 550 or higher) in various carburized steels obtained as described above. Then, the inventors compared the obtained carburized steels with a steel for carburizing in the related art (having the C content of approximately 0.2%) and obtained a threshold value for the hardenability index Ceq such that hardness of the carburized layer and the effective case depth (depth of a region having a Vickers hardness of HV 550 or higher) equal to or higher than that in the related art can be achieved. That is, according to the knowledge of the inventors, when the hardenability index Ceq is 7.5 or smaller, it is not possible to achieve characteristics equal to those of the steel in the related art (having the C content of approximately 0.2%). Therefore, the hardenability index Ceq needs to be greater than 7.5. In addition, according to the knowledge of the inventors, when the hardenability index Ceq is 44.0 or greater, the hardness of a steel for carburizing before forging increases, the deformation resistance increases, and then the critical compression ratio decreases, so that the cold forgeability of the steel for carburizing is impaired. Therefore, the hardenability index Ceq needs to range from greater than 7.5 to smaller than 44.0. It is desirable that this hardenability index Ceq is set to be great as much as possible within the above-described range. The lower limit value for the hardenability index Ceq may be preferably set to 8.0, 12.1, or 20.1. In addition, the upper limit value for the hardenability index Ceq may be set to 43.0, 42.0, or 36.0.

[Metallographic Structure]

Ferrite: 85 to 100 area %

The metallographic structure of the steel for carburizing of the present embodiment includes ferrite of 85 area % or more. Since the metallographic structure thereof has soft ferrite as a main constituent, the steel for carburizing of the present embodiment is sufficiently soft and has excellent cold forgeability. The more the ferrite, the more preferable. Therefore, the upper limit value for the amount of ferrite is 100 area %. As long as the amount of ferrite is within the above-described range, the steel for carburizing of the present embodiment may include an arbitrary structure other than ferrite. Examples of a structure which can be included in the steel for carburizing of the present embodiment include bainite and martensite.

The method of measuring the amount of ferrite is not particularly limited and may follow a routine procedure. For example, a steel for carburizing is cut perpendicularly to the rolling direction. The structure is manifested by polishing and etching the cross section obtained as described above. Photographs of at least five structures are captured. The percentage of ferrite in each photograph of the structure is acquired through an image analysis. The area ratios of ferrite in the photographs of the structure are averaged. Then, the area ratio of ferrite of the steel for carburizing can be accurately acquired. It is preferable that the image capturing locations for the photographs of the structure are in an intermediate region between a surface and the center of a steel for carburizing (in a case where the steel for carburizing is a round bar, a D/4 position). The reason is that an intermediate region between a surface and the center of a steel for carburizing has the average constitution of the steel for carburizing.

The hardness of the steel for carburizing of the present embodiment is not particularly limited. However, the Vickers hardness of the steel for carburizing of the present embodiment is preferably 125 HV or lower and is more preferably 110 HV or lower. In this case, the critical compression ratio of the steel for carburizing of the present embodiment becomes 68% or higher, thereby exhibiting more excellent cold forgeability. It is preferable that Vickers hardness of the steel for carburizing of the present embodiment can be controlled by performing heat treatment, and the lower the Vickers hardness, the more preferable. In consideration of the chemical composition, the experimental result, and the like, it is assumed that the lower limit value for the Vickers hardness of the steel for carburizing of the present embodiment is approximately 75 HV. The lower limit value for the Vickers hardness of the steel for carburizing of the present embodiment may be set to 80 HV or 95 HV.

[Carburized Steel Component]

Next, the carburized steel component according to another embodiment of the present invention will be described.

Figure 2:
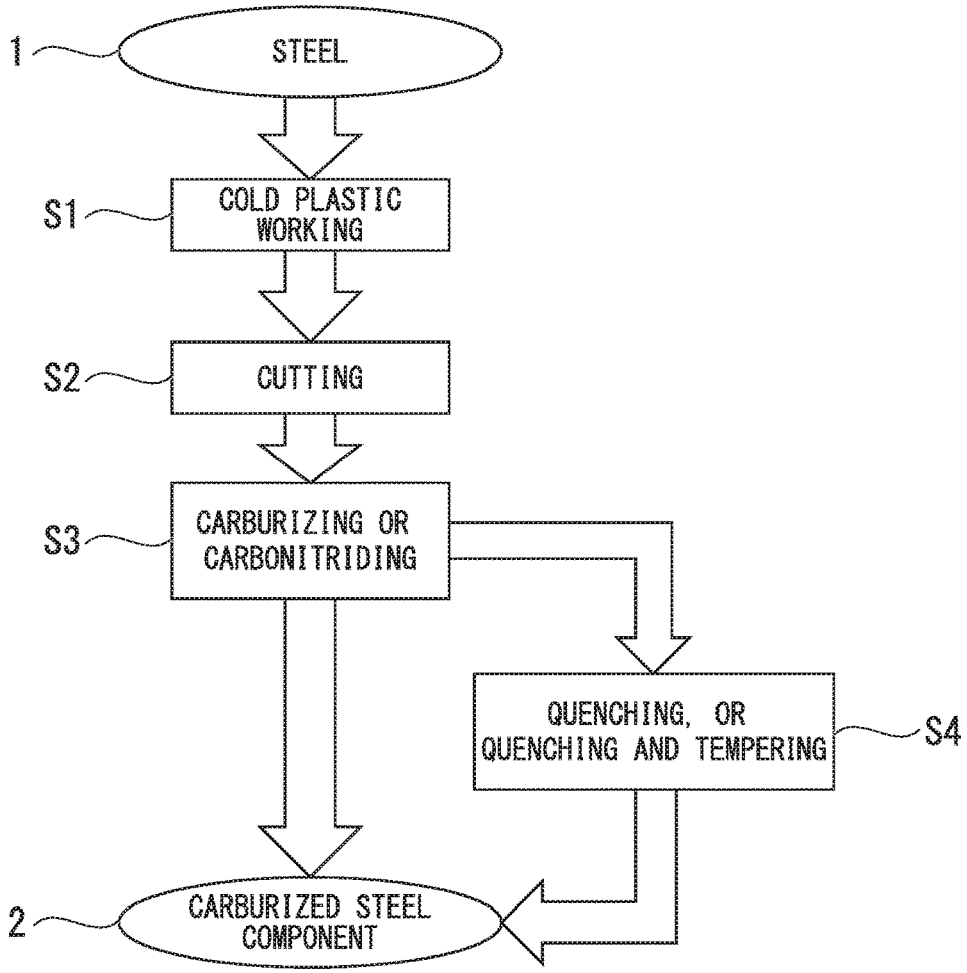
FIG. 2 is a flow chart of a method for manufacturing a carburized steel component according to the aspect of the present invention.

As shown in FIG. 2, a carburized steel component 2 of the present embodiment is manufactured by cold plastic working S1, cutting S2, and carburizing or carbonitriding S3 with respect to the steel 1 for carburizing according to the present embodiment described above. After the carburizing or carbonitriding S3, as necessary, quenching, or quenching and tempering S4 may be performed as finish heat treatment. Through the carburizing or carbonitriding S3, a carburized layer 21 is formed on an outer surface of a steel portion 20 of the carburized steel component 2. The carburized layer 21 of the carburized steel component 2 according to the present embodiment is defined as a region having a Vickers hardness of HV 550 or higher. The thickness of the carburized layer 2 is equal to the effective case depth regulated by JIS G 0557. Between the steel portion 20 and the carburized layer 21, there may be a region which corresponds to none of the steel portion 20 and the carburized layer 21, that is, a transition region having a C content higher than that in the steel portion 20 and having hardness of less than HV 550. According to the common general technical knowledge, the term "carburized layer" is understood to be a concept including both the carburized layer and the carbonitride layer. The method for manufacturing the carburized steel component 2 will be described below.

The thickness of the carburized layer: a range from greater than 0.40 mm to smaller than 2.00 mm More specifically, as shown in FIG. 1, the carburized steel component 2 of the present embodiment includes the steel portion 20 and the carburized layer 21 which is generated on the outer surface of the steel portion 20 and has a thickness ranging from greater than 0.40 mm to smaller than 2.00 mm. In a case where the thickness of the carburized layer is 0.40 mm or smaller, the strength, particularly, the fatigue strength and the like of the carburized steel component become insufficient. Meanwhile, in a case where the thickness of the carburized layer is 2.00 mm or greater, toughness of the surface of the carburized steel component is impaired. The lower limit value for the thickness of the carburized layer may be set to 0.45 mm, 0.50 mm, or 0.55 mm. In addition, the upper limit value for the thickness of the carburized layer may be set to 1.70 mm, 1.50 mm, 1.00 mm, 0.90 mm, 0.70 mm, 0.65 mm, or 0.60 mm.

The average Vickers hardness at a position in the depth of 50 μm from a surface of the carburized steel component: a range from HV 650 or higher to HV 1,000 or lower In addition, it is preferable that the average Vickers hardness at a position in the depth of 50 μm from a surface of the carburized steel component 2 according to the present embodiment (in FIG. 1, the dotted line with the sign A) ranges from HV 650 or higher to HV 1,000 or lower. In this case, hardness of the carburized layer is appropriately controlled. In a case where the average Vickers hardness at a position in the depth of 50 μm from a surface of the carburized steel component 2 is less than HV 650, the strength, particularly, the fatigue strength and the like of the carburized steel component become insufficient. In a case where the average Vickers hardness at a position in the depth of 50 μm from a surface of the carburized steel component 2 exceeds HV 1,000, the toughness of the surface of the carburized steel component is impaired. The lower limit value for the average Vickers hardness at a position in the depth of 50 μm from a surface of the carburized steel component 2 may be set to HV 750, HV 770, or HV 800. The upper limit value for the average Vickers hardness at a position in the depth of 50 μm from a surface of the carburized steel component 2 may be set to HV 900, HV 870, or HV 850.

The average Vickers hardness at a position in the depth of 2.0 mm from a surface of the carburized steel component: a range from HV 250 or higher to HV 500 or lower Furthermore, it is preferable that the average Vickers hardness at a position in the depth of 2.0 mm from a surface of the carburized steel component 2 according to the present embodiment (in FIG. 1, the dotted line with the sign B) ranges from HV 250 or higher to HV 500 or lower. In this case, hardness of the steel portion 20 (or the transition portion) is appropriately controlled. In a case where the average Vickers hardness at a position in the depth of 2.0 mm from a surface of the carburized steel component 2 is less than HV 250, strength of the carburized steel component becomes insufficient. In a case where the average Vickers hardness at a position in the depth of 2.0 mm from a surface of the carburized steel component 2 exceeds HV 500, toughness of the carburized steel component is impaired and a failure such as a crack is likely to occur. The lower limit value for the average Vickers hardness at a position in the depth of 2.0 mm from a surface of the carburized steel component 2 may be set to HV 270, HV 280, or HV 300. The upper limit value for the average Vickers hardness at a position in the depth of 2.0 mm from a surface of the carburized steel component 2 may be set to HV 400, HV 380, or HV 320.

The Vickers hardness of the carburized layer 21 becomes harder than that of the steel 1 for carburizing (material) through the carburizing or carbonitriding S3. In addition, in a case where the Vickers hardness of the steel portion 20 after the carburizing or carbonitriding S3 becomes insufficient, the quenching, or quenching and tempering S4 may be performed as finish heat treatment such that the Vickers hardness of the steel portion 20 becomes HV 250 or higher.

The thickness of the carburized layer 21 of the carburized steel component 2 is acquired by obtaining a hardness transition curve indicating a relationship between a perpendicular distance from a surface of the carburized layer 21 and hardness. The hardness transition curve is obtained by cutting the carburized steel component 2 perpendicularly to its surface, polishing the cut surface, and measuring the hardness based on, for example, JIS G 0557 "Measurement Test of Carburized Case Depth of Steel". The thickness of the carburized layer 21, that is, the thickness of a region having a Vickers hardness of HV 550 or higher can be read from the hardness transition curve. The thickness of the carburized layer 21 is measured at two locations or more, and the average value of the measurement values may be taken as the thickness of the carburized layer 21 of the carburized steel component 2.

The average Vickers hardness at a position in the depth of 50 μm from a surface of the carburized steel component 2 and at a position in the depth of 2.0 mm from a surface of the carburized steel component 2 can be obtained by cutting the carburized steel component 2 perpendicularly to its surface, polishing the cut surface, performing a Vickers hardness measuring test a plurality of times (preferably five times or more) at a position in the depth of 50 μm and at a position in the depth of 2.0 mm, and calculating the average value of the results thereof.

The chemical composition, the hardenability index Ceq, the average distance between fine sulfides, and the presence density of fine sulfides in the steel portion 20 of the carburized steel component 2 do not substantially change through carburizing or carbonitriding, thereby being substantially the same as those of the steel 1 for carburizing, which is a material of the carburized steel component 2. The rolling direction of the carburized steel component 2 coincides with the elongation direction of sulfides in the carburized steel component 2. Therefore, the rolling direction thereof can be specified by observing the shape of sulfides in the carburized steel component 2. Meanwhile, since quenching and tempering occurs during the carburizing or carbonitriding S3, hardness of the steel portion 20 is higher than the hardness of the steel 1 for carburizing, which is a material of the carburized steel component 2.

As long as the thickness and hardness of the carburized layer are controlled as described above, the carburized steel component according to the present embodiment can be used as a high strength component. Therefore, the structure of the carburized steel component according to the present embodiment is not particularly limited. However, for example, the structure in the depth of 0.4 mm from a surface of the carburized steel component may be constituted of ferrite ranging from 0 to 10 area % and a remainder including at least one selected from the group consisting of martensite, bainite, tempered martensite, tempered bainite, and cementite. In a case where the carburized steel component is manufactured such that the composition and the hardness at a position in the depth of 2.0 mm from a surface of the carburized steel component and at a position in the depth of 50 μm is within the range described above, the structure in the depth of 0.4 mm from a surface of the carburized steel component is generally within the above-described range.

[Manufacturing Method]

Next, the method for manufacturing the steel for carburizing of the present embodiment and the method for manufacturing the carburized steel component according to another embodiment of the present invention will be described. In regard to the method for manufacturing the carburized steel component, as an example, a process of manufacturing a cold forged product constituted of a steel for carburizing will be described. For example, a cold forged product is a machine component utilized in automobiles, construction machinery, and the like. For example, a cold forged product is a steel component such as a gear, a shaft, and a pulley.

The method for manufacturing the steel for carburizing of the present embodiment has the same chemical composition as that in the steel for carburizing of the present embodiment and is manufactured by continuously casting a slab in which the primary arm spacing of dendrite within a range of 15 mm from a surface is shorter than 600 μm, performing hot working of this slab, and further performing annealing. Hot working may include hot rolling.

[Continuous Casting Process]

A slab having the same chemical composition as the steel for carburizing of the present embodiment is manufactured through a continuous casting method. A slab may be made into an ingot (steel ingot) through an ingot-making method. For example, casting is performed using a mold of 220×220 mm square under conditions in which super-heating of a molten steel inside a tundish ranges from 10° C. to 50° C. and the casting speed ranges from 1.0 to 1.5 m/min.

Furthermore, in order to cause the primary arm spacing of dendrite within a range of 15 mm from a surface of a slab to be shorter than 600 μm, when a molten steel is cast, the average cooling rate within a temperature range from a liquidus temperature to a solidus temperature in the depth of 15 mm from a slab surface (hereinafter, will be sometimes simply referred to as "average cooling rate") needs to range from 100° C./min or faster to 500° C./min or slower. When the average cooling rate is slower than 100° C./min, there is concern that it is difficult to cause the primary arm spacing of dendrite at a position in the depth of 15 mm from a slab surface to be shorter than 600 μm and sulfides cannot be finely dispersed. Meanwhile, when the average cooling rate exceeds 500° C./min, there is concern that sulfides crystallized from among dendrite branches become excessively fine, the presence density of sulfides having an equivalent circle diameter ranging from 1 μm or greater to smaller than 2 μm and the average distance between the sulfides are beyond the above-described range, and the machinability of the steel for carburizing is degraded.

The temperature range from the liquidus temperature to the solidus temperature indicates a temperature range from a solidification start temperature to a solidification end temperature of a molten steel. Therefore, the average cooling rate in this temperature range denotes the average solidification rate (that is, the average cooling rate at the time of solidification) of a slab. For example, the average cooling rate can be achieved by techniques such as controlling the size of a cross section of the mold, the casting speed, and the like to proper values, and increasing the quantity of cooling water used for water cooling immediately after casting. These techniques can be applied to both the continuous casting method and the ingot-making method.

The average cooling rate within the temperature range from the liquidus temperature to the solidus temperature in the depth of 15 mm from a slab surface can be estimated by observing secondary arm spacing of dendrite of a slab. For example, a cross section of a slab is etched with picric acid. One hundred points of secondary arm spacing $\lambda_2$ (μm) of dendrite are measured at a position in the depth of 15 mm from a slab surface at the pitch of 5 mm in the casting direction. Based on the following Expression C, a cooling rate A (° C./sec) within the temperature range from the liquidus temperature to the solidus temperature of a slab is calculated from the values thereof. The arithmetical mean value of this cooling rate A is assumed to substantially coincide with the average cooling rate within the temperature range from the liquidus temperature to the solidus temperature in the depth of 15 mm from a slab surface. However, when a slab is subjected to hot working, there are cases where the shape of dendrite changes or the shape of dendrite cannot be discriminated any longer. Therefore, it is difficult to accurately estimate the average cooling rate based on the shape of dendrite in the steel for carburizing of the present embodiment obtained through hot working of a slab.

$$\lambda_2 = 710 \times A^{-0.39} \quad \text{(Expression C)}$$

For example, a plurality of slabs are manufactured under various casting conditions, and the average cooling rate of each slab is acquired by Expression C, and an optimal casting condition may be determined from the obtained cooling rates.

A slab or an ingot is subjected to hot working, and a billet (steel piece) is manufactured. Furthermore, the billet is subjected to hot working, thereby forming a steel bar, a wire rod, and the like.

As the hot working process, a slab after the casting process is subjected to hot rolling, hot forging, or the like, thereby obtaining a hot-working steel material. The plastic working conditions such as the working temperature, the reduction, and the strain rate in the hot working process are not particularly limited. Preferable conditions may be suitably selected.

As the slow cooling process, the hot-working steel material immediately after this hot working process (that is, not substantially cooled) is subjected to slow cooling such that the cooling rate within the temperature range, in which the surface temperature of the hot-working steel material ranges from 800° C. to 500° C., ranges from faster than 0° C./sec to 1° C./sec or slower, thereby obtaining the steel for carburizing of the present embodiment.

When the cooling rate within 800° C. to 500° C. that is a temperature range in which austenite is transformed into ferrite and pearlite exceeds 1° C./sec, the structure fraction of bainite and martensite in a steel for carburizing increases, and the amount of ferrite in the steel for carburizing becomes insufficient. As a result, hardness of the steel for carburizing increases, deformation resistance increases, and then the critical compression ratio decreases. Therefore, it is preferable that the cooling rate within the temperature range is limited to a range from faster than 0° C./sec to 1° C./sec or slower. It is more preferable that the cooling rate within the temperature range is set to range from faster than 0° C./sec to 0.7° C./sec or slower. As the slow cooling process, in order to reduce the cooling rate of a hot-working steel material after the hot working process, a thermal insulation cover, a thermal insulation cover with a heat source, a retaining furnace, or the like may be installed after a rolling line or a hot forging line.

In addition, spheroidizing annealing may be further performed after slow cooling so as to form the steel for carburizing of the present embodiment. When spheroidizing annealing treatment is performed, hardness of the steel for carburizing is further degraded, deformation resistance further decreases, and then the critical compression ratio further increases. The spheroidizing annealing conditions are not particularly limited. Preferable conditions may be suitably selected.

Next, the method for manufacturing the carburized steel component according to the present embodiment will be described.

A steel for carburizing which has a chemical composition constituted of the basic elements and the optional elements described above, and a remainder including Fe and impurities and is manufactured via the above-described manufacturing process is subjected to the cold plastic working S1, so that the shape is applied. The plastic working conditions such as the reduction and the strain rate in the cold plastic working are not particularly limited. Preferable conditions may be suitably selected.

Next, the steel for carburizing after the cold plastic working is subjected to the cutting S2, so that the shape of a component for machine structural use is applied. A precise shape which is difficult to form with only the cold plastic working can be applied to the steel for carburizing through cutting. Since the steel for carburizing of the present embodiment has excellent machinability, cutting chip disposability is high compared to that in a steel in the related art and the life span of the tool is not impaired in cutting.

Cutting may be executed before the cold plastic working or may be executed after thereof. However, in order to improve dimensional accuracy of the carburized steel component, it is preferable that cutting is executed after the cold plastic working.

Next, the steel for carburizing to which the shape is applied through the cold plastic working and cutting is subjected to the carburizing or carbonitriding S3, thereby obtaining the carburized steel component according to the present embodiment. The conditions of carburizing or carbonitriding are not particularly limited and may be suitably selected in accordance with desired strength of the carburized steel component. In order to obtain a carburized steel component which includes the carburized layer and the steel portion described above and has hardness within the range described above, it is preferable that the steel for carburizing according to the present embodiment is subjected to carburizing treatment or carbonitriding treatment under the conditions in which the carburizing temperature ranges from 830° C. to 1,100° C., the carbon potential ranges from 0.5% to 1.2%, and the carburizing time is one hour or longer.

After carburizing or carbonitriding, as necessary, quenching, or quenching and tempering S4 may be executed. Particularly, quenching, or quenching and tempering may be performed in a case where Vickers hardness of the steel portion of the carburized steel component after carburizing or carbonitriding is insufficient. The conditions of quenching and tempering are not particularly limited and may be suitably selected in accordance with desired strength of the carburized steel component. In order to obtain a carburized steel component which includes the carburized layer and the steel portion described above and has hardness within the range described above, it is preferable that quenching, or quenching and tempering are executed under the conditions in which the temperature of a quenching medium ranges from room temperature to 250° C. In addition, as necessary, sub-zero treating may be performed with respect to the carburized steel component after quenching.

In addition, as necessary, grinding or shot-peening may be further performed with respect to the carburized steel component after quenching, or quenching and tempering. When grinding is performed, a precise shape which is difficult to be formed through only the cold plastic working can be applied to the steel for carburizing. When shot-peening is performed, compressive residual stress is introduced to the surface layer area of the carburized steel component. Since compressive residual stress suppresses occurrence and development of a fatigue crack, fatigue strength of the carburized steel component (particularly, in a case where the carburized steel component is a gear, fatigue strength of a tooth root and a tooth surface) can be further improved. The conditions of shot-peening are not particularly limited. However, it is desirable that shot peening media having a diameter of 0.7 mm or smaller are used and shot-peening is performed under the conditions in which the arc height is 0.4 mm or greater.

According to the method for manufacturing the carburized steel component according to the present embodiment, it is possible to provide a steel for carburizing having excellent cold forgeability and machinability. The steel for carburizing according to the present embodiment is obtained by casting a slab having a predetermined chemical composition under predetermined conditions. The dendrite structures which become crystallized nuclei of sulfides are refined, and the sulfides in the steel are finely dispersed. Accordingly, the steel for carburizing according to the present embodiment has high machinability after cold forging (that is, machinability before carburizing), the steel for carburizing according to the present embodiment is preferable as a material of steel components such as gears, shafts, and pulleys.

As described above, the steel for carburizing of the present embodiment is excellent in machinability when cutting is performed with respect to a roughly formed product which can be obtained through cold forging after annealing. Accordingly, in the steel for carburizing of the present embodiment, it is possible to reduce the percentage of the cutting cost in the manufacturing costs of steel components such as gears, shafts, and pulleys for automobiles and industrial machinery, and it is possible to improve the quality of the components.

The steel for carburizing of the present embodiment has a composition in which the amount of carbon is comparatively small, a minute amount of Bi is included, and the hardenability index Ceq is controlled within a preferable range while sulfides are finely dispersed therein. Therefore, deformation resistance at the time of cold forging is small, machinability after cold forging is high, and strength after carburizing is high. Particularly, in the steel for carburizing of the present embodiment, since Vickers hardness is set to HV 125 or lower, for example, deformation resistance at the time of cold forging is small. In addition, the critical compression ratio can also be set to 68% or higher, so that cold forgeability is favorable. When the manufacturing process of the carburized steel component according to the present embodiment is applied to the steel for carburizing of the present embodiment, it is possible to obtain a carburized steel component having Vickers hardness of the steel portion of HV 250 or higher and Vickers hardness of the carburized layer of HV 650 or higher, which is preferable as a material of the carburized steel component.

In addition, according to the carburized steel component of the present embodiment, the steel portion and the carburized layer which is generated on the outer surface of the steel portion are included, the Vickers hardness of the carburized layer at a position in the depth of 50 μm from a surface of the carburized steel component ranges from HV 650 or higher to HV 1,000 or lower, and the Vickers hardness of the steel portion at a position in the depth of 2.0 mm from a surface of the carburized steel component ranges from HV 250 or higher to HV 500 or lower. Therefore, the carburized steel component of the present embodiment can be preferably used as machine components such as gears, shafts, and pulleys.

As described above, according to the present embodiment, it is possible to provide a steel for carburizing having excellent cold forgeability and machinability, and a method for manufacturing the same.

Hereinabove, the embodiment of the present invention has been described. However, the embodiment described above is merely an example for executing the present invention. Thus, the present invention is not limited to the embodiment described above, and the embodiment described above can be executed in a suitable modification form within a range not departing from the gist thereof.

EXAMPLES

Example 1

Steels a to Z having the chemical compositions shown in Table 1A and Table 1B were melted and made into ingots using a converter (270 ton), continuous casting was executed using a continuous casting machine, and slabs of 220×220 mm square were manufactured. Here, super-heating of a molten steel inside a tundish was set to 30° C., and the casting speed was set to 1.0 m/min.

In continuous casting of the slabs, the average cooling rate within the temperature range from the liquidus temperature to the solidus temperature at a position in the depth of 15 mm from a surface of a slab was controlled by changing the quantity of cooling water of a mold. In this manner, slabs a to Z which had the chemical compositions shown in Table 1A and Table 1B and in which the primary arm spacing of dendrite within the range of 15 mm from the surface layer was shorter than 600 μm were continuously cast.

The steels a to o shown in Table 1A and Table 1B are steels having the chemical compositions regulated by the present invention. The steels p to Z are steels of Comparative Examples of which the chemical compositions are beyond the conditions regulated by the present invention. The underlined numerical values in Table 1A and Table 1B indicate that the values are beyond the range regulated by the present invention. In addition, in Table 1A and Table 1B, the amount of the element which is not included or of which the amount is below the level to be considered as impurities remains blank.

In order to gather test pieces for observing a dendrite structure, the slabs before hot forging were temporarily cooled to room temperature, and the test pieces were gathered. Thereafter, each of the slabs was heated at 1,250° C. for two hours, and the slabs after heating were subjected to hot forging. Then, a plurality of round bars having a diameter of 30 mm were manufactured. After hot forging, the round bars were subjected to air cooling at the atmosphere. Air cooling was performed by covering the round bars with the thermal insulation covers and leaving the covered round bars as they were such that the cooling rate within the temperature range from 800° C. to 500° C. became 1° C./sec or slower. Furthermore, a portion of the round bars after air cooling were subjected to spheroidizing annealing (SA). In this manner, steel materials including steels for carburizing of the test numbers 1 to 27 were manufactured.

[Method of Observing Solidification Structure]

The primary arm spacing of dendrite and the secondary arm spacing of dendrite in the solidification structure of the slab were acquired by etching a cross section of the slab with picric acid, measuring one hundred points of the primary arm spacing of dendrite and the secondary arm spacing at the pitch of 5 mm in the casting direction at a position in the depth of 15 mm from a slab surface, calculating the average value of the primary arm spacing and the secondary arm spacing of dendrite in each of the measurement points, and averaging the calculated average values. The average cooling rate of the slabs in Example estimated based on the secondary arm spacing of dendrite of the slabs in Example ranged from 100° C./min or faster to 500° C./min or slower.

[Microstructure Test]

The microstructure of the round bar (steel for carburizing) of each steel number was observed. The D/4 position of the round bar was cut parallel to the axial direction, and a test piece for observing the microstructure was gathered. The cut surface of the test piece was polished, the metallographic structure of the steel was observed using an optical microscope, and the kind of the precipitate was discriminated from the contrast in the structure. The precipitate was identified using an electronic scanning microscope and an energy dispersive X-ray spectroscopic analysis apparatus (EDS). Ten polished test pieces each having a height of 10 mm and a width of 10 mm were prepared from a cross section including the longitudinal direction of the test piece described below. Electromicroscopic photographs of the cut surface in a plurality of measuring locations were captured. Sulfides (fine sulfides) having an equivalent circle diameter ranging from 1 μm or greater to smaller than 2 μm were specified by calculating each equivalent circle diameter of the sulfides included in each electromicroscopic photograph. The presence density of fine sulfides in each measuring location was acquired by dividing the number of fine sulfides included in each electromicroscopic photograph by the area of the visual field of each electromicroscopic photograph. The presence density of sulfides (presence density of fine sulfides) which were observed in a cross section parallel to the rolling direction of the steel and had an equivalent circle diameter ranging from 1 μm or greater to smaller than 2 μm was acquired by averaging the obtained values of presence density. In addition, the centers of gravity of two arbitrary fine sulfides included in each electromicroscopic photograph described above were taken as both ends thereof, and a segment which passed through no fine sulfide except for the two arbitrary fine sulfides was rendered in each electromicroscopic photograph. The average distance between fine sulfides in each measuring location was acquired by acquiring the average value of the lengths of the segments in each electromicroscopic photograph. Then, the average distance between sulfides (distance between sulfides) which were observed in a cross section parallel to the rolling direction of the steel and had an equivalent circle diameter ranging from 1 μm or greater to smaller than 2 μm was acquired by further averaging the average distances in each measuring location. The number of measuring locations was 25, the magnification of the electromicroscopic photographs was 500-fold, and the total area of the measurement visual field was approximately 1.1 $mm^2$.

In addition, the steel for carburizing was cut perpendicularly to the rolling direction. The structure was manifested by polishing and etching the cross section obtained as described above. Photographs of five structures were captured. The percentage of ferrite in each photograph of the structure was acquired through an image analysis. The area ratios of ferrite in the photographs of the structure were averaged. Then, the area ratio of ferrite of the steel for carburizing was acquired. The image capturing location for the photograph of the structure was the D/4 portion. As a result, it was checked that the area ratios of ferrite in all Examples were within the regulation range of the present invention. Although the steel k in Example having a comparatively large amount of C included martensite and bainite which were structures other than ferrite, its area ratio of ferrite were 85%. Therefore, the steel k satsifies the requirement of the present invention.

[Hardness Measuring Test]

Hardness of the round bar (steel for carburizing) was acquired by using a Vickers hardness meter, measuring hardness at ten measurement points in a cross section perpendicular to the rolling direction of the round bar, and calculating the average value of hardness in each measurement point. The position of the measurement point was the D/4 position of the round bar (position in the ¼ depth of the diameter D of the round bar). In a case where the hardness of the steel for carburizing after the slow cooling process and before spheroidizing annealing (before the SA process) was HV 125 or lower, or in a case where the hardness of the steel for carburizing after spheroidizing annealing (after the SA process) was HV 110 or lower, softening was sufficient, thereby being determined to be acceptable.

[Cold Forgeability Test]

A round bar test piece was prepared from the R/2 position of the round bar (position in the ½ depth of the radius R of the round bar) having a diameter of 30 mm. The round bar test piece was a test piece having the diameter of 10 mm and the length of 15 mm around the R/2 position of the round bar having a diameter of 30 mm, and the longitudinal direction of the round bar test piece was parallel to a cogging axis of the round bar having a diameter of 30 mm. In addition, a notch was provided in the center of the end surface of the round bar test piece. The depth of the notch was set to 0.8 mm, the notch angle was set to 30 degrees, and the bottom portion of the notch was rounded to have a radius R of 0.15 mm. This notch configuration was based on the notch of the test piece No. 2 disclosed in "The test method of cold heading", the material research group of cold forging subcommittee, Journal of the Japan Society for Technology of Plasticity, vol. 22, No. 241, p. 139.

Ten round bar test pieces were prepared for each steel. A hydraulic press (500 ton) was used for the cold compression test. Cold compression was performed at a speed of 10 mm/min using a binding dice. The compression was halted when a minute crack of 0.5 mm or greater occurred in the vicinity of the notch, and compression efficiency at that time was calculated. This measurement was performed ten times in total. The compression efficiency was acquired such that cumulative failure probability becomes 50%, and the compression efficiency was taken as the critical compression ratio. Since the critical compression ratio of a steel for carburizing after spheroidizing annealing in the related art was approximately 65%, the test piece having a critical compression ratio of 68% or higher which was considered to be a value obviously higher than this value, after the slow cooling process and before spheroidizing annealing (before the SA process) or after spheroidizing annealing (after the SA process) was determined as a test piece having an excellent critical compression ratio.

[Machinability Test]

In each of the steels, strain was applied to the test piece subjected to the cold compression test through drawing during cold working. Accordingly, an influence similar to that of general cold forging was applied to each of the test pieces. Machinability after cold forging of the steel was evaluated by evaluating the machinability of the test piece after the drawing.

Specifically, the round bar having a diameter of 30 mm subjected to the cold compression test was subjected to cold drawing at the reduction of area of 30.6%, and a steel bar having a diameter of 25 mm was formed. The steel bar which has been subjected to cold drawing was cut into a piece having a length of 500 mm, and a test material for lathe turning was obtained.

The outer circumferential portion of the test material which was obtained as described above and has the diameter of 25 mm and the length of 500 mm was subjected to lathe turning under the following conditions using an NC lathe, and machinability was investigated. After the lapse of ten minutes from the start of lathe turning, the wear amount (mm) of the flank of the super-hard tool was measured. When the measured wear amount of the flank was 0.2 mm or smaller, it was determined to be excellent in the life span of the tool.

<Used Chip>

Material of base metal: P-20 type grade carbide

Coating: none

<Lathe Turning Condition>

Cutting speed: 150 m/min

Feeding: 0.2 mm/rev

Cutting depth: 0.4 mm

Lubrication: water-soluble cutting oil used

Cutting chip disposability was evaluated by the following method. Cutting chips discharged during ten seconds in the cutting machinability test were collected. The lengths of the collected cutting chips were investigated, and ten cutting chips were selected in the descending order. The total weight of the ten selected cutting chips was defined as the "cutting chip weight". In a case where cutting chips were elongated and the total number of cutting chips was less than ten as a result, the average weight of the collected cutting chips was measured and the value which was multiplied by ten was defined as the "cutting chip weight". For example, in a case where the total number of cutting chips was seven and its total weight was 12 g, the cutting chip weight was calculated as (12 g/7 pieces)×10 pieces. The sample having a cutting chip weight of 15 g or lighter was determined to have high cutting chip disposability.

[Carburizing Characteristics Evaluation Test]

The test piece (20 mmϕ×30 mm) for carburizing was gathered from a position of the ¼ depth of the diameter in the cut surface from the circumferential surface of the steel for carburizing manufactured by the method described above, such that the longitudinal direction of the test piece coincided with the longitudinal direction of the steel for carburizing. As carburizing, gas carburizing was through a conversion furnace gas method. In this gas carburizing, the carbon potential was set to 0.8%, the test piece was held at 950° C. for five hours. Subsequently, the test piece was held at 850° C. for 0.5 hours. After the carburizing, as the finish heat treating, oil quenching for cooling the steel after carburizing to 130° C. was performed. Then, tempering was performed at 150° C. for 90 minutes, and a carburized steel component was obtained.

Characteristics of the carburized layer and the steel portion of the carburized steel component manufactured under the conditions described above were evaluated. Table 2A and Table 2B show the measurement results thereof.

In regard to the carburized layer of the carburized steel component, hardness at a position in the depth of 50 μm from a surface and hardness at a position in the depth of 2.0 mm from a surface were measured ten times in total using the Vickers hardness meter, and the average value was calculated. The sample of which the average value of hardness at a position in the depth of 50 μm from a surface ranges from HV 650 or higher to HV 1,000 or lower and the average value of hardness at a position in the depth of the depth 2.0 mm from a surface ranges from HV 250 or higher to HV 500 or lower was determined as a sample in which hardness was sufficiently ensured.

Furthermore, in order to measure the thickness of the carburized layer of the carburized steel component, hardness distribution from the surface of the carburized steel component to the position in the depth of 5 mm in the carburized steel component was measured at three locations using the Vickers hardness meter, and the depth of the region in which hardness was HV 550 or higher was measured for each location. Subsequently, the average value of these depths was calculated, and the result was considered as the thickness of the carburized layer of the carburized steel component. The sample having the thickness of the carburized layer ranging from greater than 0.4 mm to smaller than 2.0 mm was determined to be accepted in regard to the thickness of the carburized layer.

The chemical compositions of the steels a to o were within the range of the chemical composition of the steel for carburizing of the present invention, and all of the hardenability index, the number fraction of sulfides, and the average distance between sulfides satisfied the targets. As a result, the steels a to o and the test numbers 1 to 15 satisfied the performance required as a steel for carburizing and a carburized steel component.

The test number 16 (steel p) had the same composition as that of a general steel as the kinds of a steel for general use satisfying the standard of JIS standard SCr 420H. In the steel p, since the amounts of C, Cr, Ti, B, Bi, and N were out of the range regulated by the present invention, the number fraction of sulfides and the average distance between sulfides did not satisfy the range of the present invention. Accordingly, the critical compression ratio and machinability of the steel p (steel for carburizing) were insufficient.

The test number 17 (steel q) and the test number 18 (steel r) did not contain Bi. Therefore, the number fractions of the sulfides and the average distances between sulfides thereof did not satisfy the range of the present invention. As a result, the flank wear amounts of these Comparative Examples exceeded 0.20 mm, and the cutting chip weights exceeded 15 g.

The test number 19 (steel s) did not contain B. Therefore, hardness of the carburized steel component of the test number 19 at a position in the depth of 2.0 mm became insufficient.

In the test number 20 (steel t), since the N content in the chemical composition did not satisfy the range of the present invention, it became an example in which the critical compression ratio of the steel for carburizing and hardness of the steel portion of the carburized steel component were insufficient. The critical compression ratio of the steel for carburizing of the test number 20 became insufficient because coarse TiN was generated due to a large amount of N and it became fracture origins at the time of cold working. The hardness of the carburized steel component of the test number 20 at a position in the depth of 2.0 mm became insufficient because the amount of the solute B decreased due to an excessive amount of N and an effect of improving hardenability by the solute B could not be sufficiently achieved.

In the test number 21 (steel u), since the S content in the chemical composition did not satisfy the range of the present invention, it became an example in which the critical compression ratio of the steel for carburizing was insufficient. The critical compression ratio of the steel for carburizing of the test number 21 became insufficient because coarse sulfides were generated due to a large amount of S and they became fracture origins at the time of cold working.

In the test number 22 (steel v), since the S content in the chemical composition did not satisfy the range of the present invention, it became an example in which machinability of the steel for carburizing was insufficient. Since the test number 22 (steel V) had excessive Bi, hot workability was poor and it was difficult to execute normal hot rolling.

In the test number 23 (steel w), since the hardenability index did not satisfy the range of the present invention, it became an example in which hardness of the carburized steel component at a position in the depth of 2.0 mm was insufficient.

In the test number 24 (steel x), since the C content in the chemical composition did not satisfy the range of the present invention, it became an example in which hardness of the steel for carburizing was insufficient.

In the test number 25 (steel y), since the C content in the chemical composition did not satisfy the range of the present invention, it became an example in which the critical compression ratio of the steel for carburizing was insufficient and hardness was excessive.

In the test number 26 (steel z), since the Ti content in the chemical composition did not satisfy the range of the present invention, it became an example in which hardness of the steel portion and the carburized layer of the carburized steel component and the thickness of the carburized layer were insufficient.

TABLE 1A

| | Chemical composition (mass %) remainder: Fe and impurities | | | | | | | | | | | | | | | |
|---|---|---|---|---|---|---|---|---|---|---|---|---|---|---|---|---|
| Steel | C | Si | Mn | P | S | Cr | Mo | Ni | Cu | V | Ti | Nb | Al | B | Bi | Remarks |
| a | 0.10 | 0.25 | 0.50 | 0.015 | 0.0150 | 1.80 | | | | | 0.025 | | 0.030 | 0.0020 | 0.0030 | Examples |
| b | 0.10 | 0.21 | 0.05 | 0.015 | 0.0052 | 2.30 | | | | | 0.025 | | 0.030 | 0.0020 | 0.0030 | |
| c | 0.10 | 0.50 | 0.20 | 0.015 | 0.0055 | 1.70 | | | | | 0.025 | | 0.030 | 0.0020 | 0.0089 | |
| d | 0.10 | 0.10 | 0.04 | 0.015 | 0.0050 | 2.40 | | | | | 0.025 | 0.003 | 0.030 | 0.0020 | 0.0002 | |
| e | 0.10 | 0.0001 | 0.78 | 0.015 | 0.0150 | 1.65 | | | | | 0.025 | | 0.030 | 0.0020 | 0.0015 | |
| f | 0.10 | 0.37 | 0.54 | 0.015 | 0.0180 | 1.54 | 0.005 | | | | 0.025 | 0.004 | 0.040 | 0.0020 | 0.0025 | |
| g | 0.10 | 0.20 | 0.67 | 0.015 | 0.0050 | 1.80 | | | | | 0.055 | | 0.035 | 0.0020 | 0.0030 | |
| h | 0.10 | 0.25 | 0.50 | 0.015 | 0.0650 | 1.80 | 0.005 | 0.006 | | | 0.025 | | 0.035 | 0.0020 | 0.0045 | |
| i | 0.10 | 0.15 | 0.35 | 0.015 | 0.0450 | 5.00 | | | 0.006 | | 0.025 | | 0.030 | 0.0020 | 0.0041 | |
| j | 0.07 | 0.05 | 0.46 | 0.015 | 0.0060 | 1.55 | | | | | 0.025 | 0.002 | 0.030 | 0.0020 | 0.0010 | |
| k | 0.13 | 0.01 | 0.20 | 0.015 | 0.0210 | 1.80 | | | | 0.10 | 0.025 | | 0.030 | 0.0020 | 0.0016 | |
| l | 0.10 | 0.10 | 0.80 | 0.045 | 0.0780 | 3.20 | | | | | 0.025 | | 0.030 | 0.0020 | 0.0094 | |
| m | 0.08 | 0.25 | 0.50 | 0.014 | 0.0750 | 1.80 | | | | | 0.096 | | 0.014 | 0.0045 | 0.0005 | |
| n | 0.10 | 0.05 | 0.55 | 0.015 | 0.0210 | 1.80 | | 0.58 | | | 0.021 | | 0.030 | 0.0020 | 0.0010 | |
| o | 0.11 | 0.34 | 0.21 | 0.005 | 0.0650 | 3.60 | | | | 0.10 | 0.024 | | 0.094 | 0.0009 | 0.0005 | |
| p | 0.20 | 0.25 | 0.80 | 0.015 | 0.0150 | 1.10 | | | | | – | | 0.035 | – | – | Comparative Examples |
| q | 0.10 | 0.26 | 0.50 | 0.015 | 0.0150 | 1.78 | | | | 0.005 | 0.025 | | 0.030 | 0.0020 | – | |
| r | 0.10 | 0.24 | 0.49 | 0.015 | 0.0050 | 1.80 | | | | | 0.025 | | 0.030 | 0.0020 | – | |
| s | 0.10 | 0.25 | 0.51 | 0.015 | 0.0150 | 1.81 | 0.01 | | | | 0.025 | | 0.030 | – | 0.0021 | |
| t | 0.10 | 0.25 | 0.50 | 0.015 | 0.0150 | 1.80 | | | 0.01 | | 0.025 | | 0.030 | 0.0020 | 0.0035 | |
| u | 0.10 | 0.26 | 0.53 | 0.015 | 0.1500 | 1.79 | | | | | 0.025 | | 0.030 | 0.0020 | 0.0050 | |
| v | 0.10 | 0.25 | 0.51 | 0.015 | 0.0001 | 1.80 | | 0.006 | | | 0.025 | | 0.030 | 0.0020 | 0.0110 | |
| w | 0.10 | 0.05 | 0.01 | 0.015 | 0.0130 | 1.20 | | | | | 0.025 | | 0.030 | 0.0020 | 0.0045 | |
| x | 0.05 | 0.25 | 0.48 | 0.015 | 0.0150 | 1.80 | | | | | 0.025 | 0.003 | 0.030 | 0.0020 | 0.0024 | |
| y | 0.18 | 0.24 | 0.50 | 0.015 | 0.0150 | 1.70 | | | | | 0.020 | | 0.030 | 0.0020 | 0.0028 | |
| x | 0.10 | 0.25 | 0.55 | 0.015 | 0.0150 | 1.85 | | | | | 0.005 | | 0.035 | 0.0020 | 0.0035 | |

TABLE 1A-continued

| Steel | Chemical composition (mass %) remainder: Fe and impurities | | | | | | | | | | | | | | | Remarks |
|---|---|---|---|---|---|---|---|---|---|---|---|---|---|---|---|---|
| | C | Si | Mn | P | S | Cr | Mo | Ni | Cu | V | Ti | Nb | Al | B | Bi | |
| y | 0.18 | 0.24 | 0.50 | 0.015 | 0.0150 | 1.70 | | | | | 0.020 | | 0.030 | 0.0020 | 0.0028 | |
| z | 0.10 | 0.25 | 0.55 | 0.015 | 0.0150 | 1.85 | | | | | 0.005 | | 0.035 | 0.0020 | 0.0035 | |

The empty space in Table denotes that the element is not added or is the detection limit or less.
The underlined value in Table indicates that the value is beyond out of the condition defined by the present invention.

TABLE 1B

| Steel | Chemical composition (mass %) remainder: Fe and impurities | | | | | | | | | Remarks |
|---|---|---|---|---|---|---|---|---|---|---|
| | Ca | Mg | Te | Zr | REM | Sb | N | O | Ceq | |
| a | | | | | | | 0.0045 | 0.0018 | 20.4 | Examples |
| b | | | | | 0.0010 | | 0.0035 | 0.0016 | 8.4 | |
| c | | | | | | | 0.0035 | 0.0020 | 12.7 | |
| d | 0.0002 | | | | | | 0.0045 | 0.0010 | 8.0 | |
| e | | | | | | | 0.0045 | 0.0015 | 22.7 | |
| f | 0.0002 | | 0.0015 | | | | 0.0030 | 0.0023 | 20.8 | |
| g | | | | 0.0011 | | | 0.0074 | 0.0011 | 24.6 | |
| h | | | | | | | 0.0035 | 0.0021 | 20.7 | |
| i | | | | | | | 0.0045 | 0.0026 | 36.3 | |
| j | | | | | | 0.0030 | 0.0045 | 0.0010 | 15.1 | |
| k | | | | | | | 0.0035 | 0.0010 | 9.9 | |
| l | | | | | | | 0.0035 | 0.0010 | 43.0 | |
| m | | 0.0012 | | | | | 0.0040 | 0.0016 | 20.4 | |
| n | | | | | | | 0.0040 | 0.0014 | 23.3 | |
| o | | | | | | | 0.0040 | 0.0011 | 22.5 | |
| p | | | | | | | 0.0130 | 0.0015 | 20.2 | Comparative |
| q | | | | | | | 0.0035 | 0.0010 | 20.3 | Examples |
| r | | | | | 0.0020 | | 0.0035 | 0.0012 | 20.0 | |
| s | | | | | | | 0.0035 | 0.0011 | 21.4 | |
| t | | 0.0012 | | | | | 0.0100 | 0.0021 | 20.4 | |
| u | | | | | | | 0.0030 | 0.0010 | 21.3 | |
| v | | | | 0.0010 | | | 0.0032 | 0.0012 | 20.7 | |
| w | | | 0.0020 | | | | 0.0030 | 0.0011 | 3.9 | |
| x | 0.0025 | | | | | | 0.0030 | 0.0015 | 19.8 | |
| y | | | | | | 0.0025 | 0.0035 | 0.0011 | 19.4 | |
| z | | | | | | | 0.0045 | 0.0016 | 22.3 | |

The empty space in Table denotes that the element is not added or is the detection limit or less.
The underlined value in Table indicates that the value is out of the condition defined by the present invention.

TABLE 2A

| Test No. | Steel | Evaluation result of steel for carburizing | | | | | | | | | | Remarks |
|---|---|---|---|---|---|---|---|---|---|---|---|---|
| | | Hardness (HV) | | Critical compression ratio (%) | | Presence density of sulfides | Distance between | Wear amount of flank (mm) | | Cutting chip weight (g) | | |
| | | Before SA process | After SA process | Before SA process | After SA process | (pieces/mm$^2$) | sulfides (μm) | Before SA process | After SA process | Before SA process | After SA process | |
| 1 | a | 117 | 104 | 68 | 69 | 351 | 23.5 | 0.12 | 0.11 | ≤15 g | ≤15 g | Examples |
| 2 | b | 108 | 99 | 70 | 71 | 325 | 25.2 | 0.17 | 0.16 | ≤15 g | ≤15 g | |
| 3 | c | 125 | 109 | 68 | 68 | 326 | 24.6 | 0.19 | 0.18 | ≤15 g | ≤15 g | |
| 4 | d | 102 | 95 | 70 | 72 | 325 | 26.1 | 0.15 | 0.14 | ≤15 g | ≤15 g | |
| 5 | e | 108 | 99 | 69 | 70 | 351 | 24.8 | 0.17 | 0.16 | ≤15 g | ≤15 g | |
| 6 | f | 124 | 108 | 68 | 69 | 359 | 23.5 | 0.19 | 0.18 | ≤15 g | ≤15 g | |
| 7 | g | 117 | 104 | 70 | 71 | 325 | 25.3 | 0.14 | 0.12 | ≤15 g | ≤15 g | |
| 8 | h | 117 | 104 | 68 | 69 | 480 | 17.9 | 0.17 | 0.15 | ≤15 g | ≤15 g | |
| 9 | i | 120 | 106 | 68 | 69 | 429 | 15.2 | 0.17 | 0.15 | ≤15 g | ≤15 g | |
| 10 | j | 96 | 92 | 74 | 75 | 328 | 25.8 | 0.19 | 0.18 | ≤15 g | ≤15 g | |
| 11 | k | 107 | 98 | 70 | 70 | 366 | 24.2 | 0.15 | 0.14 | ≤15 g | ≤15 g | |
| 12 | l | 120 | 103 | 68 | 69 | 359 | 24.0 | 0.11 | 0.10 | ≤15 g | ≤15 g | |
| 13 | m | 115 | 101 | 68 | 70 | 560 | 24.6 | 0.14 | 0.12 | ≤15 g | ≤15 g | |
| 14 | n | 111 | 99 | 70 | 71 | 425 | 24.5 | 0.16 | 0.15 | ≤15 g | ≤15 g | |

TABLE 2A-continued

| Test No. | Steel | Evaluation result of steel for carburizing: Hardness (HV) Before SA process | Hardness (HV) After SA process | Critical compression ratio (%) Before SA process | Critical compression ratio (%) After SA process | Presence density of sulfides (pieces/mm$^2$) | Distance between sulfides (μm) | Wear amount of flank (mm) Before SA process | Wear amount of flank (mm) After SA process | Cutting chip weight (g) Before SA process | Cutting chip weight (g) After SA process | Remarks |
|---|---|---|---|---|---|---|---|---|---|---|---|---|
| 15 | o | 106 | 94 | 68 | 69 | 521 | 23.5 | 0.19 | 0.18 | ≤15 g | ≤15 g | |
| 16 | p | *149 | *123 | *61 | *65 | *267 | *32.4 | *0.32 | *0.26 | *>15 g | *>15 g | Comparative Examples |
| 17 | q | 117 | 104 | 68 | 69 | *267 | *33.6 | *0.27 | *0.24 | *>15 g | *>15 g | |
| 18 | r | 116 | 103 | 68 | 69 | *250 | *36.7 | *0.30 | *0.27 | *>15 g | *>15 g | |
| 19 | s | 117 | 104 | 69 | 70 | 413 | 16.8 | 0.20 | 0.18 | ≤15 g | ≤15 g | |
| 20 | t | 117 | 104 | *64 | *66 | 351 | 18.6 | *0.21 | 0.19 | ≤15 g | ≤15 g | |
| 21 | u | 118 | 105 | *65 | *66 | 701 | 15.1 | 0.07 | 0.06 | ≤15 g | ≤15 g | |
| 22 | v | 117 | 104 | 70 | 72 | *267 | *32.5 | *0.35 | *0.31 | *>15 g | *>15 g | |
| 23 | w | 95 | 91 | 71 | 71 | 324 | 25.1 | 0.19 | 0.18 | ≤15 g | ≤15 g | |
| 24 | x | 78 | 77 | 70 | 72 | 351 | 24.0 | 0.19 | 0.19 | ≤15 g | ≤15 g | |
| 25 | y | *139 | *117 | *65 | *67 | 351 | 23.7 | 0.18 | 0.15 | ≤15 g | ≤15 g | |
| 26 | z | 115 | 105 | 69 | 69 | 355 | 23.7 | 0.12 | 0.11 | ≤15 g | ≤15 g | |

The value with the sign "*" is out of the range of the present invention or out of the range of the characteristic level required in the present invention.

TABLE 2B

| Test No. | Steel | Evaluation result of carburized steel component: Hardness at position in depth of 50 μm (HV) | Hardness at position in depth of 2.0 mm (HV) | Thickness of carburized layer (mm) | Remarks |
|---|---|---|---|---|---|
| 1 | a | 823 | 300 | 0.55 | Examples |
| 2 | b | 825 | 287 | 0.53 | |
| 3 | c | 862 | 292 | 0.54 | |
| 4 | d | 867 | 287 | 0.53 | |
| 5 | e | 822 | 302 | 0.55 | |
| 6 | f | 836 | 300 | 0.55 | |
| 7 | g | 746 | 304 | 0.55 | |
| 8 | h | 796 | 300 | 0.55 | |
| 9 | i | 813 | 317 | 0.58 | |
| 10 | j | 827 | 294 | 0.55 | |
| 11 | k | 830 | 289 | 0.53 | |
| 12 | l | 812 | 315 | 0.60 | |
| 13 | m | 820 | 300 | 0.55 | |
| 14 | n | 821 | 296 | 0.55 | |
| 15 | o | 800 | 310 | 0.58 | |
| 16 | p | 798 | 306 | 0.56 | Comparative Examples |
| 17 | q | 823 | 304 | 0.55 | |
| 18 | r | 845 | 307 | 0.55 | |
| 19 | s | 897 | *224 | *0.39 | |
| 20 | t | 865 | *203 | *0.37 | |
| 21 | u | 748 | 302 | 0.55 | |
| 22 | v | 845 | 304 | 0.56 | |
| 23 | w | 834 | *215 | *0.39 | |
| 24 | x | 824 | *224 | *0.39 | |
| 25 | y | 867 | 299 | 0.55 | |
| 26 | z | *603 | *221 | *0.39 | |

The value with the sign "*" is out of the range of the present invention or out of the range of the characteristic level required in the present invention.

Example 2

Under the same manufacturing conditions as the steel a and the steel h except for the average cooling rate (hereinafter, will be referred to as the "average cooling rate") within the temperature range from the liquidus temperature to the solidus temperature at a position in the depth of 15 mm from a surface of the slab, steels for carburizing having the same chemical composition as that of the steel a or the steel h were manufactured, and various evaluations were carried out with respect to these steels for carburizing by the same method as that of the steel a and the steel h. The average cooling rates followed the values shown in Table 3.

TABLE 3

| | | | Evaluation result of steel for carburizing | | | | | | | |
|---|---|---|---|---|---|---|---|---|---|---|
| | | Average | Hardness (HV) | | Critical compression ratio (%) | | Presence density of | | Wear amount of flank (mm) | |
| Test No. | Steel | cooling rate (° C./min) | Before SA process | After SA process | Before SA process | After SA process | sulfides (pieces/mm$^2$) | Distance between sulfides (μm) | Before SA process | After SA process |
| 1 | a | 200 | 117 | 104 | 68 | 69 | 351 | 23.5 | 0.12 | 0.11 |
| 1-2 | a | 650 | 116 | 104 | 69 | 70 | *235 | *35.4 | *0.26 | *0.25 |
| 1-3 | a | 50 | 117 | 103 | *65 | *66 | *165 | *44.5 | *0.35 | *0.33 |
| 8 | h | 250 | 117 | 104 | 68 | 69 | 480 | 17.9 | 0.17 | 0.15 |
| 8-2 | h | 620 | 115 | 105 | 68 | 69 | *268 | *34.3 | *0.36 | *0.34 |
| 8-3 | h | 60 | 116 | 104 | *65 | *66 | *231 | *40.5 | *0.34 | *0.32 |

| | Evaluation result of steel for carburizing Cutting chip weight (g) | | Evaluation result of carburized steel component | | | |
|---|---|---|---|---|---|---|
| Test No. | Before SA process | After SA process | Hardness at Position in depth of 50 μm (HV) | Hardness at Position in depth of 2.0 mm (HV) | Thickness of carburized layer (mm) | Remarks |
| 1 | ≤15 g | ≤15 g | 823 | 300 | 0.55 | Example |
| 1-2 | *>15 g | *>15 g | 836 | 305 | 0.54 | Comparative |
| 1-3 | *>15 g | *>15 g | 815 | 302 | 0.55 | Examples |
| 8 | ≤15 g | ≤15 g | 796 | 300 | 0.55 | Example |
| 8-2 | *>15 g | *>15 g | 799 | 306 | 0.55 | Comparative |
| 8-3 | *>15 g | *>15 g | 805 | 306 | 0.56 | Examples |

The value with the sign "*" is out of the range of the present invention or out of the range of the characteristic level required in the present invention.

As shown in Table 3, in the test numbers 1 and 8 in which the average cooling rate was within the range from 100° C. to 500° C., since sulfides were appropriately and finely dispersed, the hardness before carburizing, the critical compression ratio, the flank wear amount, and the cutting chip weight were within the acceptance range, and the thickness of the carburized layer after carburizing, the hardness of the carburized layer (hardness at a position in the depth of 50 μm), and the hardness of the steel portion (hardness at a position in the depth of 2 mm) were also within the acceptance range.

Meanwhile, in the test numbers 1-3 and 8-3 in which the average cooling rate was slower than 100° C., since sulfides were not finely dispersed, the critical compression ratio was impaired due to coarse sulfides, and machinability was also impaired. In addition, in the test numbers 1-2 and 8-2 in which the average cooling rate was faster than 500° C., since sulfides were excessively refined, the number of sulfides having an equivalent circle diameter ranging from 1 μm or greater to smaller than 2 μm was insufficient, and machinability was impaired.

INDUSTRIAL APPLICABILITY

A steel according to the present invention has excellent cold forgeability due to small deformation resistance and a high critical compression ratio and has excellent machinability before carburizing or carbonitriding. Therefore, in the steel according to the present invention, it is possible to drastically reduce the cost of cutting in the cost of manufacturing high strength components for machine structural use such as gears, shafts, and pulleys. Meanwhile, since the steel according to the present invention has high hardenability, it is possible to form a carburized layer having sufficient hardness and thickness through carburizing or carbonitriding, and a steel portion having sufficient hardness. Therefore, the steel according to the present invention can be utilized as a material for high strength components for machine structural use. A carburized steel component according to the present invention can be inexpensively manufactured and has high strength. A method for manufacturing a carburized steel component according to the present invention can be inexpensively carried out and can provide a carburized steel component having high strength. Therefore, the steel, the carburized steel component, and the method for manufacturing a carburized steel component according to the present invention have industrial applicability.

BRIEF DESCRIPTION OF THE REFERENCE SYMBOLS

1 STEEL (STEEL FOR CARBURIZING)
2 CARBURIZED STEEL COMPONENT
20 STEEL PORTION
21 CARBURIZED LAYER
S1 COLD PLASTIC WORKING
S2 CUTTING
S3 CARBURIZING OR CARBONITRIDING
S4 QUENCHING, OR QUENCHING AND TEMPERING

What is claimed is:

1. A steel, wherein a chemical composition comprises, by mass %,

C: 0.07% to 0.13%,

Si: 0.0001% to 0.50%,

Mn: 0.0001% to 0.80%,

S: 0.0050% to 0.0800%,

Cr: more than 1.30% to 5.00% or less,

B: 0.0005% to 0.0100%,

Ti: 0.020% or more to less than 0.100%,

Al: 0.010% to 0.100%,

Bi: more than 0.0001% to 0.0100% or less,

N: 0.0080% or less,

P: 0.050% or less,
O: 0.0030% or less,
Nb: 0% to 0.100%,
V: 0% to 0.20%,
Mo: 0% to 0.500%,
Ni: 0% to 1.000%,
Cu: 0% to 0.500%,
Ca: 0% to 0.0030%,
Mg: 0% to 0.0030%,
Te: 0% to 0.0030%,
Zr: 0% to 0.0050%,
a rare earth metal: 0% to 0.0050%,
Sb: 0% to 0.0500%, and
a remainder including Fe and impurities,
wherein a hardenability index Ceq obtained by substituting the amount of each element in the chemical composition indicated by mass % in Expression 1 ranges from greater than 7.5 to smaller than 44.0,
wherein a metallographic structure includes ferrite ranging from 85 to 100 area %,
wherein an average distance between sulfides, which are observed in a cross section parallel to a rolling direction of the steel and have an equivalent circle diameter ranging from 1 μm or greater to smaller than 2 μm, is shorter than 30.0 μm, and
wherein a presence density of the sulfides, which are observed in the cross section parallel to the rolling direction of the steel and have an equivalent circle diameter ranging from 1 μm or greater to smaller than 2 μm, is 300 pieces/mm$^2$ or more, $$Ceq=(0.7\times Si+1)\times(5.1\times Mn+1)\times(2.16\times Cr+1)\times(3\times Mo+1)\times(0.3633\times Ni+1) \quad \text{(Expression 1).}$$

2. The steel according to claim 1,
wherein the chemical composition includes, by mass %, one or more selected from the group consisting of
Nb: 0.002% to 0.100%,
V: 0.002% to 0.20%,
Mo: 0.005% to 0.500%,
Ni: 0.005% to 1.000%,
Cu: 0.005% to 0.500%,
Ca: 0.0002% to 0.0030%,
Mg: 0.0002% to 0.0030%,
Te: 0.0002% to 0.0030%,
Zr: 0.0002% to 0.0050%,
a rare earth metal: 0.0002% to 0.0050%, and
Sb: 0.0020% to 0.0500%.

3. A carburized steel component comprising:
a steel portion; and
a carburized layer, which is a region on an outer surface of the steel portion and which has Vickers hardness of HV 550 or higher,
wherein a thickness of the carburized layer ranges from greater than 0.40 mm to smaller than 2.00 mm,
wherein an average Vickers hardness at a position in a depth of 50 μm from a surface of the carburized steel component ranges from HV 650 or higher to HV 1,000 or lower,
wherein an average Vickers hardness at a position in a depth of 2.0 mm from the surface of the carburized steel component ranges from HV 250 or higher to HV 500 or lower,
wherein a chemical composition of the steel portion includes, by mass %,
C: 0.07% to 0.13%,
Si: 0.0001% to 0.50%,
Mn: 0.0001% to 0.80%,
S: 0.0050% to 0.0800%,
Cr: more than 1.30% to 5.00% or less,
B: 0.0005% to 0.0100%,
Ti: 0.020% or more to less than 0.100%,
Al: 0.010% to 0.100%,
Bi: more than 0.0001% to 0.0100% or less,
N: 0.0080% or less,
P: 0.050% or less,
O: 0.0030% or less,
Nb: 0% to 0.100%,
V: 0% to 0.20%,
Mo: 0% to 0.500%,
Ni: 0% to 1.000%,
Cu: 0% to 0.500%,
Ca: 0% to 0.0030%,
Mg: 0% to 0.0030%,
Te: 0% to 0.0030%,
Zr: 0% to 0.0050%,
a rare earth metal: 0% to 0.0050%,
Sb: 0% to 0.0500%, and
a remainder including Fe and impurities,
wherein a hardenability index Ceq obtained by substituting the amount of each element in the chemical composition of the steel portion indicated by mass % in Expression 2 ranges from greater than 7.5 to smaller than 44.0,
wherein an average distance between sulfides, which are observed in a cross section parallel to a rolling direction of the carburized steel component and have an equivalent circle diameter in the steel portion ranging from 1 μm or greater to smaller than 2 μm, is shorter than 30.0 μm, and
wherein a presence density of the sulfides, which are observed in the cross section parallel to the rolling direction of the carburized steel component and have an equivalent circle diameter in the steel portion ranging from 1 μm or greater to smaller than 2 μm, is 300 pieces/mm$^2$ or more, $$Ceq=(0.7\times Si+1)\times(5.1\times Mn+1)\times(2.16\times Cr+1)\times(3\times Mo+1)\times(0.3633\times Ni+1) \quad \text{(Expression 2).}$$

4. The carburized steel component according to claim 3,
wherein the chemical composition of the steel portion includes, by mass %, one or more selected from the group consisting of
Nb: 0.002% to 0.100%,
V: 0.002% to 0.20%,
Mo: 0.005% to 0.500%,
Ni: 0.005% to 1.000%,
Cu: 0.005% to 0.500%,
Ca: 0.0002% to 0.0030%,
Mg: 0.0002% to 0.0030%,
Te: 0.0002% to 0.0030%,
Zr: 0.0002% to 0.0050%,
a rare earth metal: 0.0002% to 0.0050%, and
Sb: 0.0020% to 0.0500%.

5. A method for manufacturing the carburized steel component according to claim 3, the method comprising:
cold plastic working a steel, wherein
a chemical composition comprises, by mass %,
C: 0.07% to 0.13%,
Si: 0.0001% to 0.50%,
Mn: 0.0001% to 0.80%,
S: 0.0050% to 0.0800%,
Cr: more than 1.30% to 5.00% or less,
B: 0.0005% to 0.0100%,
Ti: 0.020% or more to less than 0.100%, Al: 0.010% to 0.100%,
Bi: more than 0.0001% to 0.0100% or less,
N: 0.0080% or less,
P: 0.050% or less,
O: 0.0030% or less,
Nb: 0% to 0.100%,
V: 0% to 0.20%,
Mo: 0% to 0.500%,
Ni: 0% to 1.000%,
Cu: 0% to 0.500%,
Ca: 0% to 0.0030%,
Mg: 0% to 0.0030%,
Te: 0% to 0.0030%,
Zr: 0% to 0.0050%,
a rare earth metal: 0% to 0.0050%,
Sb: 0% to 0.0500%, and
a remainder including Fe and impurities, wherein a hardenability index Ceq obtained by substituting the amount of each element in the chemical composition indicated by mass % in Expression 1 ranges from greater than 7.5 to smaller than 44.0, wherein a metallographic structure includes ferrite ranging from 85 to 100 area %, wherein an average distance between sulfides, which are observed in a cross section parallel to a rolling direction of the steel and have an equivalent circle diameter ranging from 1 μm or greater to smaller than 2 μm, is shorter than 30.0 μm, and wherein a presence density of the sulfides, which are observed in the cross section parallel to the rolling direction of the steel and have an equivalent circle diameter ranging from 1 μm or greater to smaller than 2 μm, is 300 pieces/mm2 or more, $$Ceq=(0.7\times Si+1)\times(5.1\times Mn+1)\times(2.16\times Cr+1)\times(3\times Mo+1)\times(0.3633\times Ni+1) \quad \text{(Expression 1);}$$

cutting the steel after the cold plastic working; and carburizing or carbonitriding the steel after the cutting.

6. The method for manufacturing the carburized steel component, according to claim 5, further comprising:

quenching, or quenching and tempering after the carburizing or the carbonitriding.

7. The method for manufacturing the carburized steel component, according to claim 5, wherein the chemical composition includes, by mass %, one or more selected from the group consisting of Nb: 0.002% to 0.100%,
V: 0.002% to 0.20%,
Mo: 0.005% to 0.500%,
Ni: 0.005% to 1.000%,
Cu: 0.005% to 0.500%,
Ca: 0.0002% to 0.0030%,
Mg: 0.0002% to 0.0030%,
Te: 0.0002% to 0.0030%,
Zr: 0.0002% to 0.0050%,
a rare earth metal: 0.0002% to 0.0050%, and
Sb: 0.0020% to 0.0500%.

* * * * *